US008559839B2

(12) United States Patent
Hase et al.

(10) Patent No.: US 8,559,839 B2
(45) Date of Patent: Oct. 15, 2013

(54) FIXING DEVICE AND IMAGE FORMING APPARATUS INCORPORATING

(75) Inventors: Takamasa Hase, Kanagawa-ken (JP); Kenji Ishii, Kanagawa-ken (JP); Masaaki Yoshikawa, Tokyo (JP); Tetsuo Tokuda, Kanagawa-ken (JP); Naoki Iwaya, Tokyo (JP); Yoshiki Yamaguchi, Kanagawa-ken (JP); Yutaka Ikebuchi, Kanagawa-ken (JP); Takahiro Imada, Kanagawa-ken (JP); Toshihiko Shimokawa, Kanagawa-ken (JP); Hiroshi Yoshinaga, Chiba-ken (JP); Ippei Fujimoto, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 393 days.

(21) Appl. No.: 13/020,289

(22) Filed: Feb. 3, 2011

(65) Prior Publication Data

US 2011/0194870 A1 Aug. 11, 2011

(30) Foreign Application Priority Data

Feb. 8, 2010 (JP) ..... 2010-025340

(51) Int. Cl.
*G03G 15/20* (2006.01)

(52) U.S. Cl.
USPC ..... 399/69

(58) Field of Classification Search
USPC ..... 399/69, 70, 329, 334
See application file for complete search history.

(56) References Cited

U.S. PATENT DOCUMENTS

| | | | |
|---|---|---|---|
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |
| 6,785,505 | B2 | 8/2004 | Yasui et al. |
| 6,813,464 | B2 | 11/2004 | Amita et al. |
| 6,881,927 | B2 | 4/2005 | Yoshinaga et al. |
| 6,882,820 | B2 | 4/2005 | Shinshi et al. |
| 6,892,044 | B2 | 5/2005 | Yasui et al. |
| 6,937,827 | B2 | 8/2005 | Katoh et al. |
| 7,022,944 | B2 | 4/2006 | Yoshinaga et al. |
| 7,127,204 | B2 | 10/2006 | Satoh et al. |

(Continued)

FOREIGN PATENT DOCUMENTS

| | | |
|---|---|---|
| JP | 2884714 | 2/1999 |
| JP | 2004-191966 | 7/2004 |

(Continued)

*Primary Examiner* — William J Royer
(74) *Attorney, Agent, or Firm* — Oblon, Spivak, McClelland, Maier & Neustadt, L.L.P.

(57) ABSTRACT

A fixing device includes an endless fuser belt, a contact member, a pressure member, a heater, a first thermometer, a second thermometer, and a controller. The fuser belt is looped into a generally cylindrical configuration. The contact member extends inside the loop of the fuser belt. The pressure member extends with the fuser interposed between the contact member and the pressure member. The pressure member is pressed against the contact member through the fuser belt to form a fixing nip. The heater includes a first heating element and a second heating element. The first heating element heats the fuser belt at a first position. The second heating element heats the fuser belt at a second position. The first thermometer detects a first temperature of the fuser belt. The second thermometer detects a second temperature of the fuser belt. The controller controls each of the first and second heating elements.

12 Claims, 17 Drawing Sheets

(56) References Cited

U.S. PATENT DOCUMENTS

| | | | | |
|---|---|---|---|---|
| 7,151,907 | B2 | 12/2006 | Yoshinaga | |
| 7,239,838 | B2 | 7/2007 | Sato et al. | |
| 7,242,897 | B2 | 7/2007 | Satoh et al. | |
| 7,313,353 | B2 | 12/2007 | Satoh et al. | |
| 7,379,698 | B2 | 5/2008 | Yoshinaga | |
| 7,454,151 | B2 | 11/2008 | Satoh et al. | |
| 7,466,949 | B2 | 12/2008 | Satoh et al. | |
| 7,509,085 | B2 | 3/2009 | Yoshinaga et al. | |
| 7,546,049 | B2 | 6/2009 | Ehara et al. | |
| 7,570,910 | B2 | 8/2009 | Ishii | |
| 7,702,271 | B2 | 4/2010 | Yamada et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,840,151 | B2 | 11/2010 | Fujimoto | |
| 8,401,414 | B2 * | 3/2013 | Yoshikawa et al. | 399/69 |
| 2006/0029411 | A1 | 2/2006 | Ishii et al. | |
| 2006/0257183 | A1 | 11/2006 | Ehara et al. | |
| 2007/0014600 | A1 | 1/2007 | Ishii et al. | |
| 2008/0063443 | A1 | 3/2008 | Yoshinaga et al. | |
| 2008/0253789 | A1 | 10/2008 | Yoshinaga et al. | |
| 2008/0317532 | A1 | 12/2008 | Ehara et al. | |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0148204 | A1 | 6/2009 | Yoshinaga et al. | |
| 2009/0148205 | A1 | 6/2009 | Seo et al. | |
| 2009/0169232 | A1 | 7/2009 | Kunii et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2010/0303521 | A1 | 12/2010 | Ogawa | |
| 2011/0044706 | A1 | 2/2011 | Iwaya | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda | |
| 2011/0058866 | A1 | 3/2011 | Ishii | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii | |
| 2011/0064451 | A1 | 3/2011 | Yamaguchi et al. | |
| 2011/0064490 | A1 | 3/2011 | Imada | |
| 2011/0064502 | A1 | 3/2011 | Hase | |
| 2011/0076071 | A1 | 3/2011 | Yamaguchi et al. | |
| 2011/0129268 | A1 | 6/2011 | Ishii et al. | |

FOREIGN PATENT DOCUMENTS

| | | |
|---|---|---|
| JP | 3592485 | 9/2004 |
| JP | 2006-259683 | 9/2006 |
| JP | 2008-139805 | 6/2008 |
| JP | 2009-271998 | 11/2009 |

* cited by examiner

FIXING DEVICE AND IMAGE FORMING APPARATUS INCORPORATING

CROSS-REFERENCE TO RELATED APPLICATIONS

The present patent application claims priority pursuant to 35 U.S.C. §119 from Japanese Patent Application No. 2010-025340, filed on Feb. 8, 2010, which is hereby incorporated by reference herein in its entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of those imaging functions, incorporating such a fixing device.

2. Description of the Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, an imaging process is followed by a fixing process using a fixing device, which permanently fixes a toner image in place on the recording medium by melting and settling the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip through which a recording medium is passed to fix a toner image under heat and pressure.

One such fixing device includes a multi-roller fuser assembly that employs an endless fuser belt entrained around multiple rollers, paired with a pressure roller pressed against the outer surface of the fuser belt to form a fixing nip therebetween. The fuser belt is held on a heat roller internally equipped with a heater, which heats the length of the fuser belt through contact with the heat roller, so as to fix a toner image with heat from the fuser belt and pressure from the pressure roller through the fixing nip.

Another type of fixing device includes a film-based fuser assembly that employs a fuser belt formed of thin heat-resistant film cylindrically looped around a stationary, ceramic heater, which is paired with a pressure roller that rotates in pressure contact with the stationary heater through the fuser belt to form a fixing nip therebetween. The stationary heater heats the fixing nip, through which the pressure roller rotates to advance the fuser belt together with an incoming recording sheet, so as to fix a toner image in place with heat from the stationary heater through the fuser belt and pressure from the pressure roller.

The configuration based on the fuser belt combined with the stationary heater is commonly employed in a high-speed, on-demand printer, which can promptly execute a print job upon startup with significantly low energy consumption. Owing to the heat-resistant film which exhibits a relatively low heat capacity and therefore can be swiftly heated, this type of fixing device eliminates the need for keeping the heater in a sufficiently heated state when idle, resulting in shorter periods of wait time required to execute an initial print job upon startup, as well as smaller amounts of energy wasted during standby.

A problem common to the fuser assemblies described above is the difficulty in maintaining a fuser member at a consistent processing temperature along a circumferential direction in which the fuser member rotates in its generally cylindrical configuration. This is particularly true with the film-based assembly employing a fuser belt of low heat capacity locally heated with a stationary heater, which is vulnerable to periodic variations in temperature at the fixing nip, in particular, those caused by entry of a recording sheet absorbing heat from the fuser belt through the fixing nip, as well as fluctuations in temperature around a setpoint temperature, commonly called "ripples". The problem is pronounced where the fuser belt is heated at idle without a recording sheet entering the fixing nip, which eventually causes various imaging failures, such as variations in gloss of a resulting image and undesirable transfer or offset of toner excessively heated at the fixing nip.

To cope with the problem, various methods have been proposed that control operation of a heater that heats a fuser member according to readings of a thermometer detecting temperature around the fuser member.

For example, one conventional method controls power supply of a heater according to temperature detected by a thermometer positioned upstream of the heater along the direction of rotation of a rotatable fuser member. According to this method, the thermometer is displaced with respect to the heater along the rotational direction by a distance determined based on a rotational speed at which the fuser member rotates and a response speed at which the thermometer responds to a change in temperature, so that the heater can properly heat each specific portion of the rotating fuser member with an appropriate amount of heat determined according to the output of the thermometer.

Another conventional method employs a pair of first and second thermometers around a cylindrically looped fuser belt, the former positioned at a center and the latter at an end of the fuser belt along an axial, longitudinal direction in which the fuser belt extends. According to this method, the first thermometer detects temperature of the fuser belt whereas the second thermometer detects temperature of the heater adjacent to the axial end of the fuser belt, so as to prevent the heater from overheating the fuser belt.

Although generally successful, neither of the conventional methods provides a satisfactory solution. That is, the former method fails to properly control the power supply during standby or upon startup, since, due to the absence of a thermometer positioned adjacent to the heater, it cannot detect temperature at the fixing nip where the fuser member is heated in a non-rotating, stationary state. On the other hand, the latter method has a drawback in that it cannot effectively maintain the fuser belt at a uniform temperature along the circumferential direction based on the output from the second thermometer detecting the operating temperature of the heater, where conducting heat from the heater to the fuser belt takes time to cause a substantial response delay.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes an endless fuser belt, a contact member, a pressure member, a heater, a first thermometer, a second thermometer, and a controller. The fuser belt is looped into a generally cylindrical configuration extending in an axial direction thereof for rotation along a circumferential direction thereof. The contact member extends in the axial direction inside the loop of fuser belt. The pressure member extends in the axial direction with the fuser belt interposed between the contact member and the pressure member. The pressure member is pressed against the contact member through the fuser belt to form a fixing nip through which a recording medium is passed under heat and pressure. The heater heats the fuser belt to a setpoint temperature, and includes a first heating element and a second heating element. The first heating element heats the fuser belt at a first position. The second heating element heats the fuser belt at a second position different from the first position along the axial direction. The first thermometer detects a first temperature of the fuser belt upstream of the first position along the circumferential direction. The second thermometer detects a second temperature of the fuser belt facing the second position. The controller is connected to the first and second thermometers to control each of the first and second heating elements by adjusting an operational parameter thereof according to the first and second detected temperatures at least where the fuser belt rotates.

Other exemplary aspects of the present invention are put forward in view of the above-described circumstances, and provide a novel image forming apparatus.

In one exemplary embodiment, the image forming apparatus includes an electrophotographic imaging unit and the fixing device described above.

Still other exemplary aspects of the present invention are put forward in view of the above-described circumstances, and provide a novel method to control heating in a fixing device.

In one exemplary embodiment, the fixing device includes an endless fuser belt, a contact member, a pressure member, and a heater. The fuser belt is looped into a generally cylindrical configuration extending in an axial direction thereof for rotation along a circumferential direction thereof. The contact member extends in the axial direction inside the loop of the fuser belt. The pressure member extends in the axial direction with the fuser belt interposed between the contact member and the pressure member. The pressure member is pressed against the contact member through the fuser belt to form a fixing nip through which a recording medium is passed under heat and pressure. The heater heats the fuser belt to a setpoint temperature, and includes a first heating element and a second heating element. The first heating element heats the fuser belt at a first position. The second heating element heats the fuser belt at a second position different from the first position along the axial direction. The method includes the steps of first temperature detection, second temperature detection, and control. The first temperature detection step detects a first temperature of the fuser belt upstream of the first position along the circumferential direction. The second temperature detection step detects a second temperature of the fuser belt facing the second position. The control step controls each of the first and second heating elements by adjusting an operational parameter thereof according to the first and second detected temperatures at least where the fuser belt rotates.

BRIEF DESCRIPTION OF THE DRAWINGS

Amore complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
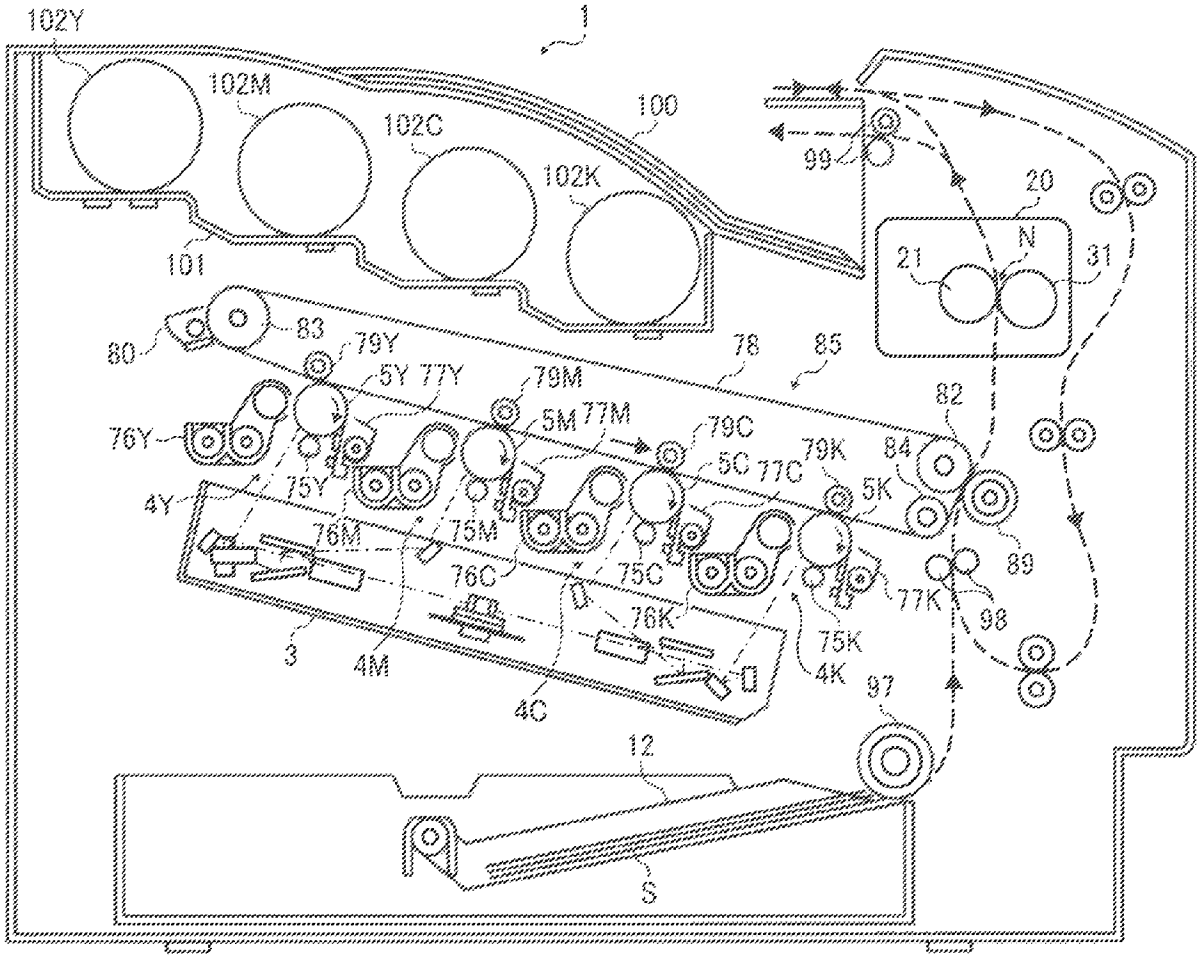
FIG. 1 schematically illustrates an image forming apparatus incorporating a fixing device according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one embodiment of this patent specification.

As shown in FIG. 1, the image forming apparatus 1 is a tandem color printer including four imaging stations 4Y, 4M, 4C, and 4K arranged in series along the length of an intermediate transfer unit 85 and adjacent to a write scanner 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop an apparatus body of the image forming apparatus 1.

In the image forming apparatus 1, each imaging unit 4Y, 4M, 4C, and 4K (indicated collectively by the reference numeral 4) has a drum-shaped photoconductor 5Y, 5M, 5C, and 5K surrounded by a charging device 75Y, 75M, 75C, and 75K, a development device 76Y, 76M, 76C, and 76K, a cleaning device 77Y, 77M, 77C, and 77K, a discharging device, not shown, and the like which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from replaceable toner bottles 102Y, 102M, 102C, and 102K, respectively, accommodated in a toner supply 101 in the upper portion of the image forming apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the drive roller 82, the intermediate transfer belt 78 travels counterclockwise in the drawing along an endless travel path, passing through four primary transfer nips defined between the primary transfer rollers 79Y, 79M, 79C, and 79K and the corresponding photoconductive drums 5Y, 5M, 5C, and 5K, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or a "fixing nip" N therebetween in the sheet conveyance path. A detailed description of the fixing device 20 will be given later with reference to FIG. 2 and subsequent drawings.

During operation, each imaging unit 4Y, 4M, 4C, and 4K rotates the photoconductor drum 5Y, 5M, 5C, and 5K clockwise in the drawing to forward its outer, photoconductive surface to a series of electrophotographic processes, including charging, exposure, development, transfer, and cleaning, in one rotation of the photoconductor drum 5Y, 5M, 5C, and 5K.

First, the photoconductive surface is uniformly charged by the charging device 75Y, 75M, 75C, and 75K and subsequently exposed to a modulated laser beam emitted from the write scanner 3. The laser exposure selectively dissipates the charge on the photoconductive surface to form an electrostatic latent image thereon according to image data representing a particular primary color. Then, the latent image enters the development device 76Y, 76M, 76C, and 76K which renders the incoming image visible using toner. The toner image thus obtained is forwarded to the primary transfer nip between the intermediate transfer belt 78 and the primary transfer roller 79Y, 79M, 79C, and 79K.

At the primary transfer nip, the primary transfer roller 79Y, 79M, 79C, and 79K applies a bias voltage of a polarity opposite that of the toner to the intermediate transfer belt 78. This electrostatically transfers the toner image from the photoconductive surface to an outer surface of the intermediate transfer belt 78, with a certain small amount of residual toner particles left on the photoconductive surface. Such transfer process occurs sequentially at the four transfer nips along the intermediate transfer belt 78 travel path, so that toner images of different colors are superimposed one atop another to form a single multicolor image on the surface of the intermediate transfer belt 78.

After primary transfer, the photoconductive surface enters the cleaning device 77Y, 77M, 77C, and 77K to remove residual toner by scraping it off with a cleaning blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

Meanwhile, in the sheet conveyance path, the feed roller 97 rotates counterclockwise in the drawing to introduce a recording sheet S from the sheet tray 12 toward the pair of registration rollers 98 being rotated. Upon receiving the fed recording sheet S, the registration rollers 98 stop rotation to hold the incoming recording sheet S therebetween, and then advance the recording sheet S in sync with the movement of the intermediate transfer belt 78 to the secondary transfer nip. At the secondary transfer nip, the multicolor image is transferred from the intermediate transfer belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the discharge rollers 99 to the output tray 100 for stacking outside the apparatus body, which completes one operational cycle of the image forming apparatus 1.

Figure 2:
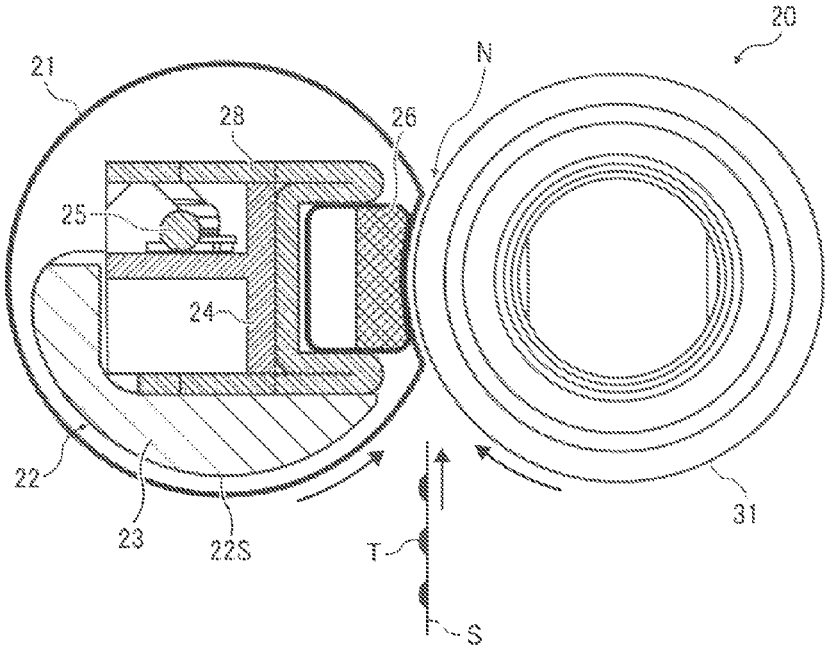
FIG. 2 is an end-on, axial cutaway view schematically illustrating the fixing device according to a first embodiment of this patent specification.

FIG. 2 is an end-on, axial cutaway view schematically illustrating the fixing device 20 incorporated in the image forming apparatus 1 according to a first embodiment of this patent specification.

As shown in FIG. 2, the fixing device 20 includes an endless, rotatable fuser sleeve or belt 21 looped into a generally cylindrical configuration for rotation along a circumferential direction, and a rotatable pressure roller 31 being a generally cylindrical roller, as well as an elongated contact pad 26 disposed inside the loop of the fuser sleeve 21, all of which extend in an axial, longitudinal direction in which the figure is drawn. The pressure roller 31 is equipped with a biasing mechanism, not shown, that presses the pressure roller 31 against the contact pad 26 via the fuser sleeve 21 to form a fixing nip N therebetween.

Figure 3A:
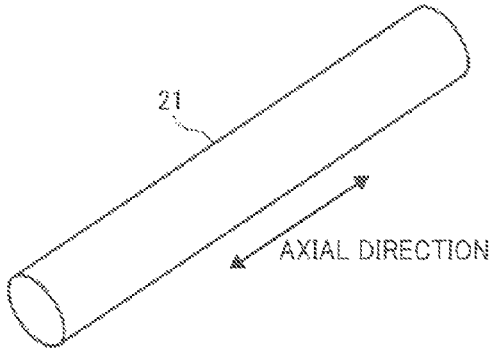
FIGS. 3A and 3B illustrate directional terms applied to the fixing device in this patent specification.
Figure 3B:
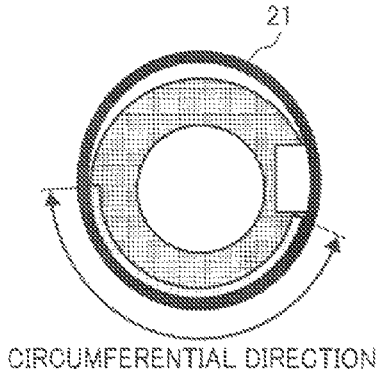

As used herein, the term "axial direction" refers to a direction parallel to a longitudinal, rotational axis around which rotates a generally cylindrical body, in particular, the fuser sleeve 21, as illustrated in FIG. 3A. The term "circumferential direction" refers to a direction along a circumference of a generally cylindrical body, in particular, that of the fuser sleeve 21, as illustrated in FIG. 3B. These directional terms apply not only to the fuser sleeve 21 itself but also to its associated structures, either in their operational position after assembly or in their original forms before or during assembly.

With continued reference to FIG. 2, inside the fuser sleeve 21 are accommodated a first mounting stay 28 shaped in the letter "H" in axial cross-section, and a second mounting stay 24 shaped in the letter "T" in axial cross-section, combined together to form a core mount on which the contact pad 26 as well as other internal structures of the fuser sleeve 21 are positioned. Along the outside of the first mounting stay 28 is a heater support 23 defining a curved surface extending along an inner circumference of the fuser sleeve 21, on which a heater 22 is positioned in contact or close proximity with the fuser sleeve 21 to heat the fuser sleeve 21 directly or indirectly. A wiring 25 extends along the second mounting stay 24 to supply the heater 22 with electricity from an external power source or an internal power storage, not shown.

In the present embodiment, the heater 22 comprises a planar heat generator 22S in the form of a thin flexible sheet that stays flat when disassembled and can be bent into a desired configuration upon assembly. The heat generator 22S is held in contact with the inner circumference of the fuser sleeve 21 to heat the fuser sleeve 21 directly by conduction, although in FIG. 2 the heater 22 is shown slightly spaced apart from the fuser sleeve 21 for illustration purposes.

During operation, upon initiation of image formation processes in response to a print request input by a user manipulating an operating panel or transmitted via a computer network, the biasing mechanism brings the pressure roller 31 into pressure contact with the contact pad 26 through the fuser sleeve 21. With a fixing nip N thus established, a rotary drive motor activates the pressure roller 31 to rotate clockwise in the drawing, which in turn rotates the fuser sleeve 21 counterclockwise in the drawing, so that the heater 22 held stationary along the curved surface of the heater support 23 slides against the inner circumference of the fuser sleeve 21.

Meanwhile, the power source starts supplying electricity to the heater 22 via the wiring 25. The heater 22, having its planar heat generator 22S thus electrified, generates heat for immediate and efficient conduction to the fuser sleeve 21 held in direct contact therewith. Initiation of the heater power supply may be simultaneous with activation of the rotary drive motor, or alternatively instead, the two events precede or follow each other with an appropriate interval of time depending on specific configuration.

Thereafter, a recording sheet S bearing an unfixed, powder toner image T enters the fixing device 20 with its front, printed face brought into contact with the fuser sleeve 21 and bottom face with the pressure roller 31. The recording sheet S moves along the rotating surfaces of the fuser sleeve 21 and the pressure roller 31 through the fixing nip N, where the fuser sleeve 21 heats the incoming recording sheet S to fuse and melt the toner particles, while the pressure roller 31 presses the recording sheet S against the contact pad 26 to cause the molten toner to settle onto the sheet surface. As the toner image T is thus fixed in place through the fixing nip N, the recording sheet S is forwarded to exit the fixing device 20.

After exit of the recording sheet S, the drive motor stops rotation of the pressure roller 31 and the fuser sleeve 21 where there is no subsequent print request. At the same time, the power supply to the heater 22 turns off where the fixing device 20 operates in a normal or sleep mode to conserve power. Contrarily, where the fixing device 20 is in a standby mode, the power supply to the heater 22 may continue to keep the fuser sleeve 21 at a certain moderate temperature so as to immediately return to operation upon receiving a future print request.

According to this patent specification, the fixing device 20 incorporates a heating control system that controls operation of the heater 22 according to readings of a contact or non-contact thermometer disposed outside the fuser sleeve 21 or embedded within the heater support 23 inside the fuser sleeve 21 to detect temperature of the fuser sleeve 21 upstream of the fixing nip N. With such heating control, the heater 22 heats the fuser sleeve 21 to a given processing temperature upon activation, and maintains sufficient heat for processing a toner image through the fixing nip N during entry of a recording sheet S. A detailed description of the heating control system and its associated structure will be given later with reference to FIG. 4 and subsequent drawings.

Still with continued reference to FIG. 2, in the present embodiment, the fuser sleeve 21 comprises a flexible, endless belt looped into a generally cylindrical configuration having a length dimensioned according to a width of recording sheet S accommodated through the fixing nip N. For example, the fuser sleeve 21 may be a multilayered endless belt having an outer diameter of approximately 30 mm in its looped, generally cylindrical configuration, consisting of a substrate of metal approximately 30 μm to approximately 50 μm thick, covered at least by an outer layer of release agent approximately 50 μm thick deposited thereupon.

The substrate of the fuser sleeve 21 may be formed of a thermally conductive metal, such as iron, cobalt, nickel, or an alloy of such metals. The release layer of the fuser sleeve 21 may be formed of a fluorine compound such as perfluoroalkoxy (PFA) formed into a 50-μm thick tubular configuration, which allows good release of toner where the fuser sleeve 21 comes into contact with the toner image T on the recording sheet S.

The pressure roller 31 comprises a cylindrical roller formed of a hollowed core of metal, such as aluminum or copper, covered with an intermediate layer of elastic, thermally insulating material, such as silicone rubber or other solid rubber, approximately 2 mm thick, and an outer layer of release agent, such as a PFA layer formed into a tubular configuration, approximately 50 μm thick, deposited one upon another. The pressure roller 31 is equipped with a drive motor that imparts rotation to the pressure roller 31 upon activation. Optionally, the pressure roller 31 may have a dedicated heater, such as a halogen heater, accommodated inside the hollow of the metal core.

The contact pad 26 comprises an elongated elastic member extending in the axial direction, having at least its front side (i.e., the side facing the pressure roller 31 via the fuser sleeve 21) formed of thermally insulating, elastic material such as fluorine rubber. The elastic front face of the contact pad 26 conforms to the circumference of the pressure roller 31 pressed against the contact pad 26, so that the fuser sleeve 21 defines a concave configuration curving inward to the contact pad 26 along which a recording sheet S moves through the fixing nip N. For good slidability and wear resistance, this front face is preferably formed of low-frictional, anti-abrasive material, such as a sheet of polytetrafluoroethylene (PTFE), commercially available under the trademark Teflon®.

The first mounting stay 28 comprises an elongated piece of rigid material extending across the axial length of the fuser sleeve 21, such as a bent sheet of metal obtained through metalworking processes, consisting of a pair of opposed, parallel side walls and a central wall perpendicular to the side walls, positioned generally centrally within the fuser sleeve 21.

The first mounting stay 28 accommodates and supports the contact pad 26 facing the pressure roller 31 between its parallel side walls, with the front face of the contact pad 26 protruding toward the pressure roller 31 slightly beyond the edges of the first mounting stay 28. Such positioning protects the contact pad 26 from substantial deformation under nip pressure from the pressure roller 31, while maintaining the first mounting stay 28 (as well as a sleeve holder employed in another embodiment) away from contact with the fuser sleeve 21.

The first mounting stay 28 also supports the heater support 23 attached to outside of its side wall, facing approximately half the inner circumference of the fuser sleeve 21 upstream of the fixing nip N. Mounting of the heater support 23 may be accomplished either by adhesive bonding to the first mounting stay 28 for ease of assembly, or by some other connecting mechanism without adhesion to the first mounting stay 28 for eliminating undesirable heat conduction from the heater support 23 to the first mounting stay 28.

The second mounting stay 24 comprises an elongated piece of material extending across the axial length of the fuser sleeve 21, consisting of a pair of flanges perpendicular to each other, one fitted between the two side walls of the first mounting stay 28, and the other extending parallel to the side walls of the first mounting stay 28, along which the wiring 25 lies electrically connecting the heater 22.

The heater support 23 comprises a rigid, partially cylindrical piece of heat-resistant, thermally insulating material. When mounted in position, the heater support 23 has its curved surface extending along a given section of the inner circumference of the generally cylindrical fuser sleeve 21, so that the heater 22 supported thereon lies in contact or close proximity with the fuser sleeve 21.

The heater support 23 may be of any thermal insulator that exhibits high heat resistance to resist heat generated by the heater 22, high mechanical strength to support the heater 22 without deformation upon contacting the rotating fuser sleeve 21, and good insulation performance to thermally isolate the first mounting stay 28 from the heater 22 for promoting heat transfer from the heater 22 to the fuser sleeve 21. For example, the heater support 23 may be configured as a molded piece of polyimide resin foam to obtain sufficient strength and immunity against deformation, particularly where the heater 22 operates in continuous contact with the rotating surface of the fuser sleeve 21 and therefore is subjected to strain toward the fixing nip N. For further reinforcement, the heater support 23 may be optionally equipped with an internal reinforcement formed of solid resin.

Figure 4:
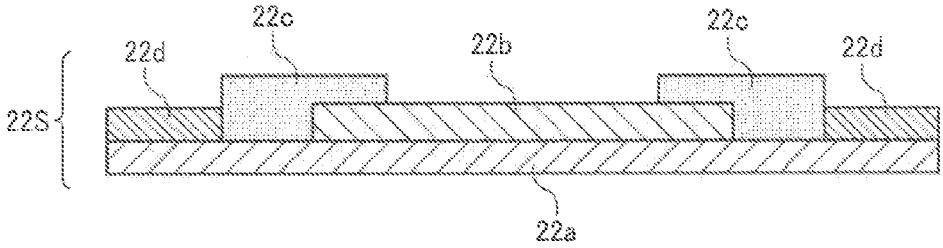
FIG. 4 is a cross-sectional view schematically illustrating a configuration of a planar heat generator employed in the fixing device of FIG. 2.

As mentioned earlier, the heater 22 in the present embodiment comprises a planar heat generator 22S in the form of a thin flexible sheet. With reference to FIG. 4, which is a cross-sectional view schematically illustrating a configuration of the planar heat generator 22S, the planar heat generator 22S is shown consisting of a substrate 22*a* of an electrically insulative material, on which are deposited a resistive heating layer 22*b* of heat-resistant material and an electrode layer 22*c* of conductive material adjoining each other to form heating circuitry, as well as an insulation layer 22*d* of an electrically insulative material for isolating the heating circuitry from adjacent electrode layers and other electrical components.

Specifically, the substrate 22*a* is a thin, elastic film of heat-resistant resin such as polyethylene terephthalate (PET), and preferably, polyimide resin for obtaining sufficient heat-resistance, electrical insulation, and flexibility.

The resistive heating layer 22*b* is a thin, conductive layer of composite material that exhibits a certain resistivity so as to generate Joule heat when supplied with electricity. For example, the resistive heating layer 22*b* may be a thin, conductive film of a heat-resistant resin such as polyimide containing uniformly dispersed particles of conductive material, such as carbon or metal, obtained by coating the substrate 22*a* with a precursor of heat-resistant resin mixed with a dispersion of conductive material. Alternatively, instead, the resistive heating layer 22*b* may be a laminated layer of heat-resistant material and conductive material, obtained by coating the substrate 22*a* initially with a conductive layer and then with a metal layer deposited thereon.

Conductive materials suitable for use in the resistive heating layer 22*b* include carbon, either in the form of carbon black particles or in the form of nano- or micro-particles consisting at least one of carbon nano-fiber, carbon nanotube, and carbon micro-coil, as well as metal, such as silver, aluminum, or nickel, in the form of particles or filaments.

The electrode layer 22*c* may be obtained by depositing a paste of conductive material, such as conductive ink or silver, or by attaching a foil or mesh of metal to the surface of the substrate 22*a*. The insulation layer 22*d* may be obtained by depositing the same insulating material used to form the substrate 22*a*, such as polyimide resin.

The planar heat generator 22S is obtained by depositing different materials one upon each other on the substrate 22*a*. That is, the substrate 22*a* is subjected initially to a deposition of resistive material to form the resistive heating layer 22*b*, then to a deposition of heat-resistant, insulating resin to form the insulation layer 22*d*, and finally to a deposition of conductive paste to form the electrode layer 22*c*, with each material being deposited through a patterned mask which exposes only a portion of the substrate 22*a* or previously deposited film to form the resulting layer in a desired configuration.

The planar heat generator 22S as a whole is a substantially smooth, thin flexible sheet approximately 0.1 mm to approximately 1 mm thick that exhibits a certain flexibility so as to conform to the curved surface of the heater support 23 when assembled. The planar heat generator 22S is dimensioned depending on specific configurations of the fuser sleeve 21, for example, approximately 20 cm in the axial direction and approximately 2 cm in the circumferential direction.

It should be noted that although the embodiment depicted in FIG. 2 shows the planar heat generator 22S extending from opposite the fixing nip N toward entry of the fixing nip N along the circumferential direction, the position, shape, and dimension of the planar heat generator 22S may be otherwise than specifically depicted herein.

In such a configuration, the planar heat generator 22S exhibits a relatively low heat capacity and therefore can rapidly produce a desired amount of heat upon activation, which can be adjusted by varying volume resistivity of the resistive heating layer 22*b*, or more precisely, by varying the type, shape, size, and dispersion of conductive particles used in the resistive heating layer 22*b*. For example, a rectangular heat generator approximately 20 cm wide and approximately 2 cm long formed of a material that produces approximately 35 watts per square centimeter ($W/cm^2$) yields a total of approximately 1,200 W output when electrified.

The resin-based planar heat generator 22S is highly durable compared to other types of heat generator, such as those formed of filaments of stainless steel or other metal. One reason is that the resin-based flexible sheet can withstand repeated flexion or stress caused by rotational vibration transmitted as the pressure roller 31 rotates during operation. Another reason is that the substantially smooth surface of the resin-based sheet is resistant to wear when sliding against the rotating fuser sleeve 21, compared to a rough, irregular surface formed of metal filaments which is susceptible to abrasion when operated in sliding contact with the inner circumference of the fuser sleeve 21. Further resistance against sliding wear can be obtained by providing an outer coating of lubricant such as fluorine resin over the resistive heating layer 22*b*.

Figure 5:
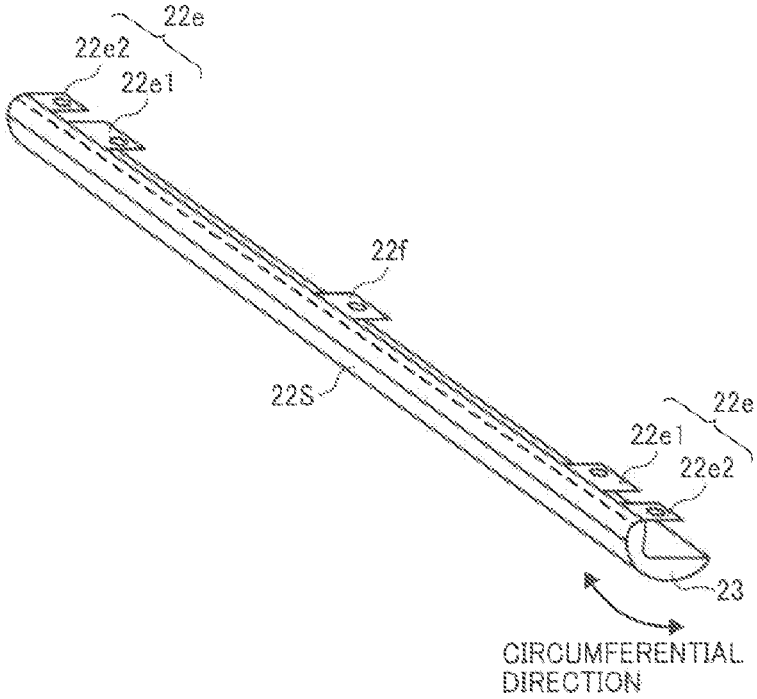
FIG. 5 is a perspective view of the planar heat generator of FIG. 4 combined with a heater support during assembly.

With additional reference to FIG. 5, which is a perspective view of the planar heat generator 22S combined with the heater support 23 during assembly, the planar heat generator 22S is shown provided with multiple screw-holed terminals disposed along its longitudinal edge, including first and second pairs of electrode terminals 22*e*1 and 22*e*2 at opposed longitudinal ends to conduct electricity from the wiring 25 to the heating circuitry, as well as a fastening terminal 22*f* at a longitudinal center for fastening the planar heat generator 22S to the second mounting stay 24.

As shown in FIG. 5, during assembly, the planar heat generator 22S is initially bonded to the curved surface of the heater support 23, with multiple terminals 22*e* and 22*f* arranged in the axial direction beyond the edge of the curved surface. Preferably, bonding the planar heat generator 22S is performed using an adhesive that exhibits a low thermal conductivity, to prevent heat from dissipating to the heater support 23 during operation.

Figure 6:
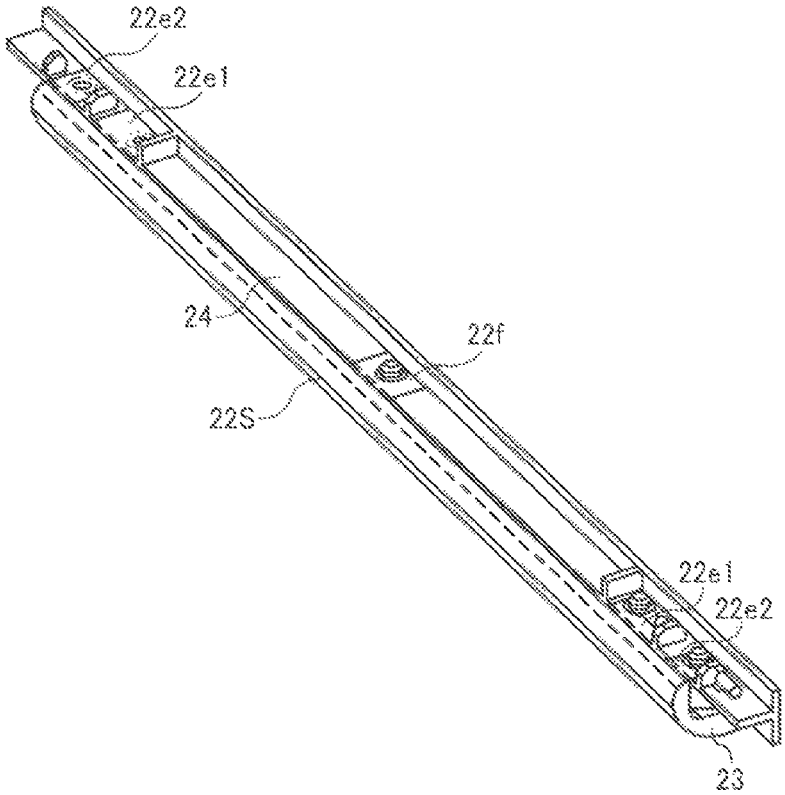
FIG. 6 is a perspective view of the planar heat generator of FIG. 4 shown with the heater support combined with a mounting stay during assembly.
Figure 7:
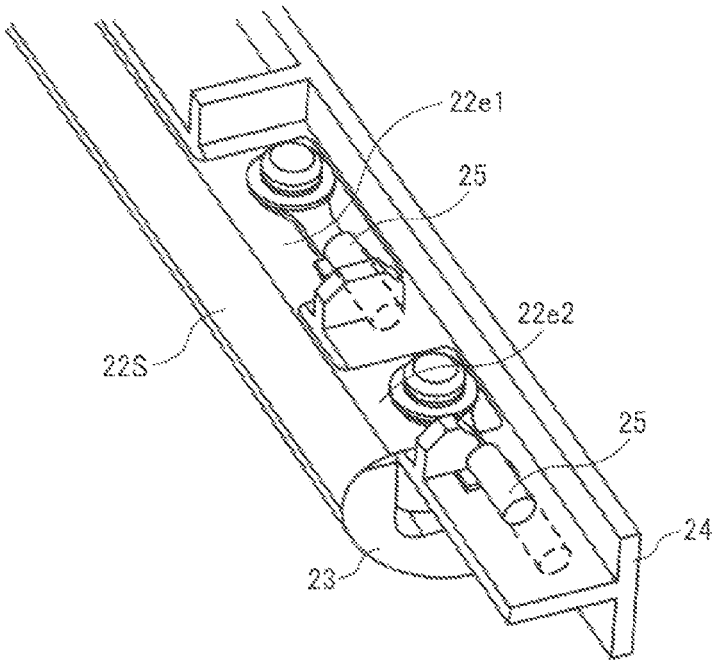
FIG. 7 is an enlarged perspective view of the planar heat generator of FIG. 4 shown with the heater support combined with the mounting stay during assembly.

With further reference to FIGS. 6 and 7, which are perspective and enlarged perspective views, respectively, of the planar heat generator 22S during assembly, the planar heat generator 22S is shown with the heater support 23 combined with the second mounting stay 24.

As shown in FIG. 6, after bonding to the heater support 23, the planar heat generator 22S is bent along the longitudinal edge of the heater support 23 with the multiple terminals 22*e* and 22*f* directed along the flange of the second mounting stay 24 (i.e., radially inward when disposed inside the fuser sleeve 21), followed by fastening the terminals 22*e* and 22*f* to the flange of the second mounting stay 24. As shown in FIG. 7, fastening the terminals 22*e* and 22*f* to the second mounting stay 24 may be accomplished using screws inserted through screw-holes provided on the stay flange and the heater terminals.

Figure 8:
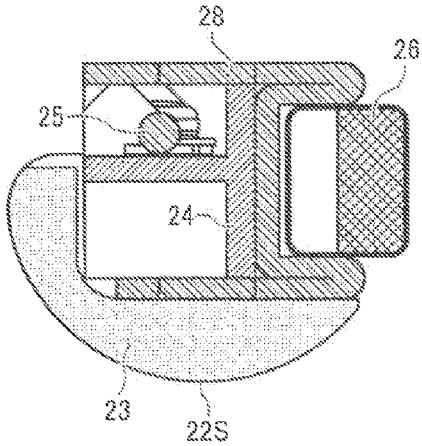
FIG. 8 is an end-on, axial cross-sectional view of an internal structure of the fixing device of FIG. 2.

The second mounting stay 24, thus combined with the heater support 23 and the planar heat generator 22S, is further combined with the first mounting stay 28 to form an internal structure for mounting inside the fuser sleeve 21. FIG. 8 is an end-on, axial cross-sectional view of such internal structure of the fuser assembly, wherein the second mounting stay 24 is inserted between the opposed sidewalls of the first mounting stay 28 opposite to the side where the contact pad 26 is installed. The single integrated structure thus obtained is subsequently inserted into the interior hollow of the fuser sleeve 21 to complete the fuser assembly for installation in the fixing device 20.

Note that in the fuser assembly, the planar heat generator 22S is fastened to the second mounting stay 24 at one longitudinal edge farthest from the fixing nip N along the circumferential direction. Where the planar heat generator 22S is not adhesively bonded to the heater support 23, fixing the longitudinal edge of the planar heat generator 22S causes the fuser sleeve 21 to pull the unfixed, opposite edge of the planar heat generator 22S toward the fixing nip N as it rotates in the circumferential direction. This in turn causes the planar heat generator 22S to establish stable contact with the inner circumference of the fuser sleeve 21, which allows for efficient heat transfer form the planar heat generator 22S to the fuser sleeve 21.

Also note that the first and second pairs of electrode terminals 22*e*1 and 22*e*2 are all provided along a single longitudinal edge of the planar heat generator 22S, so that each set of paired terminals 22*e* is positioned on opposed axial ends of the fuser assembly while extending substantially straight along the flange of the second mounting stay 24.

For comparison purposes, consider cases where a planar heat generator has a pair of electrode terminals disposed on its opposed longitudinal edges, each connected with an electrical wire or harness for deriving power from the power source. In such cases, the fuser assembly involves a pair of dedicated supports for the paired harnesses where the thin heat generator is not mechanically strong enough to withstand the weight of the electrical wiring and its associated structure, which would require a substantial space, leading to larger size of the fuser assembly.

Again for comparison, consider cases where a planar heat generator has its electrode terminals provided on its transverse edge, instead of the longitudinal edge, which is curved along the curved surface of the heater support to which the heat generator is attached. In such cases, the electrode terminals bend along with the curved edge of the heat generator upon assembly, resulting in deformation of the electrodes due to screwing on the mounting stay and complicated structure of the electrode terminals, which would make the fuser assembly difficult to handle during manufacture.

By contrast, the planar heat generator 22S of the present embodiment does not need a dedicated support for each electrical harness, nor does it involve deformation or complicated structure of the electrode terminals 22*e*1 and 22*e*2, wherein the electrical wiring 25 collectively lies on the single support of the second mounting stay 24, and the electrode terminals 22*e*1 and 22*e*2 along the single longitudinal edge are screwed without bending or deformation, which allows for compact and simple structure of the fuser assembly employing the planar heat generator 22S.

Figure 9:
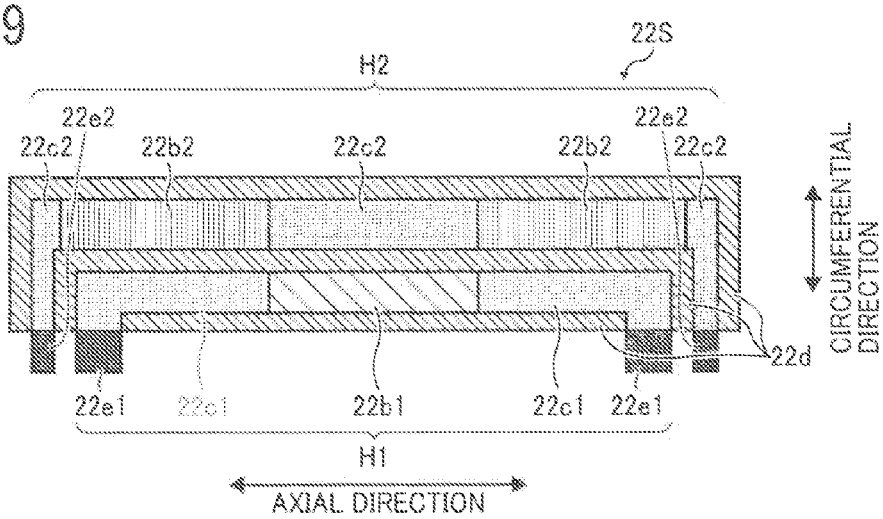
FIG. 9 is a plan view schematically illustrating one embodiment of the planar heat generator of FIG. 4 before assembly.

FIG. 9 is a plan view schematically illustrating one embodiment of the planar heat generator 22S in its original, disassembled form before assembly.

As shown in FIG. 9, the planar heat generator 22S has its entire operational area primarily divided along the axial direction into two primary sections electrically insulated from each other by the insulating layer 22*d* forming insulating regions, with each primary section being further divided along the circumferential direction to form a total of six subsections, within which the resistive heating layer 22*b* and the electrode layer 22*c* are deposited to form a resistive region and a conductive region, respectively.

Table 1 below shows the six subsections of the planar heat generator 22S as entries of a 2-by-3 matrix, positioned relative to those of the fuser sleeve 21, in which the row represents position along the circumferential direction, with "1" denoting a first side farther from the fixing nip N and "2" denoting a second side closer to the fixing nip N, and the column represents position along the axial direction, with "1" and "3" denoting a pair of axial ends opposed to each other, and "2" denoting an axial center between the opposed axial ends.

TABLE 1

| Subsections of the planar heat generator | | | | |
|---|---|---|---|---|
| | | Axial | | |
| | | First end | Center | Second end |
| Circumferential | Second side | (2, 1) | (2, 2) | (2, 3) |
| | First side | (1, 1) | (1, 2) | (1, 3) |

Specifically, the planar heat generator 22S includes a pair of first and second heating circuits (heating elements) H1 and H2, each extending across three sub-sections along the axial direction on one circumferential side. The heating circuits H1 and H2 operate independently of each other with the insulation layers 22*d* provided between and around the heating circuits H1 and H2 to prevent short-circuiting across the planar heat generator 22S.

More specifically, the first heating circuit H1 consists of a first resistive region 22*b*1 formed in the subsection (1, 2) and first conductive regions 22*c*1 formed in the subsections (1, 1) and (1, 3) on the opposed sides of the subsection (1, 2), with a first pair of electrode terminals 22*e*1 connected to the opposed conductive regions 22*c*1. The second heating circuit H2 consists of second resistive regions 22*b*2 formed in the subsections (2, 1) and (2, 3) and second conductive regions 22*c*2 formed in the subsection (2, 2) as well as in the subsections (2, 1) and (2, 3), with a second pair of electrode terminals 22*e*2 connected to the opposed conductive regions 22*c*2.

In such a configuration, the planar heat generator 22S can selectively heat the subsection (1, 2) corresponding to the axial center of the fuser sleeve 21 by activating the first heating circuit H1 with power supplied across the first pair of electrode terminals 22*e*1, which causes the first resistive region 22*b*1 to generate Joule heat, leaving the first conductive regions 22*c*1 therearound substantially unheated.

By contrast, the planar heat generator 22S can selectively heat the subsections (2, 1) and (2, 2) corresponding to the opposed axial ends of the fuser sleeve 21 by activating the second heating circuit H2 with power supplied across the second pair of electrode terminals 22*e*2, which causes the second resistive regions 22*b*2 to generate Joule heat upon activation, leaving the second conductive regions 22*c*2 therearound substantially unheated.

Thus, the planar heat generator 22S can selectively heat intended portions of the fuser sleeve 21 by activating corresponding one(s) of the multiple heating circuits H1 and H2 that operate independently of each other. Such selective heating capability of the planar heat generator 22S enables the fixing device 20 to efficiently accommodate different sizes of recording sheet S for thermal processing through the fixing nip N.

For example, to process a small-sized, narrow recording sheet through the fixing nip N, the fixing device 20 activates solely the first heating circuit H1 by energizing the first and second electrode terminals 22*e*1, or alternatively, both the first and second heating circuits H1 and H2 by energizing the first electrode terminals 22*e*1 and 22*e*2, the former with greater power supply than the latter. The first heating circuit H1 thus activated selectively heats the axial center of the fuser sleeve 21 where the fixing process takes place upon entry of the narrow recording sheet.

By contrast, to process a large-sized, wide recording sheet through the fixing nip N, the fixing device 20 activates both the first and second heating circuits H1 and H2 by energizing the first and second electrode terminals 22*e*1 and 22*e*2. The first and second heating circuits H1 and H2 thus activated heat the entire length of the fuser sleeve 21 where the fixing process takes place upon entry of the wide recording sheet.

Heating the fuser sleeve 21 by activating either or both of the multiple heating circuits H1 and H2 depending on the size of recording sheet S in use results in reduced power consumed by the fixing device 20. In particular, selectively using the first heating circuit H1 in processing small-sized sheets in succession prevents excessive heating of non-operating portions of the fuser sleeve 21, which would otherwise trigger shutdown for protection against machinery damage, resulting in reduced yields of the fixing device 20.

Selective heating capability provided by the single, integral planar heat generator 22S is superior to that provided by separate heating circuits formed of different materials, as the multiple heating circuits H1 and H2, formed of the same material through the same process during manufacture, exhibit similar thermal properties to ensure the planar heat generator 22S heats the fuser sleeve 21 uniformly along the axial direction as well as along the circumferential direction.

Figure 10:
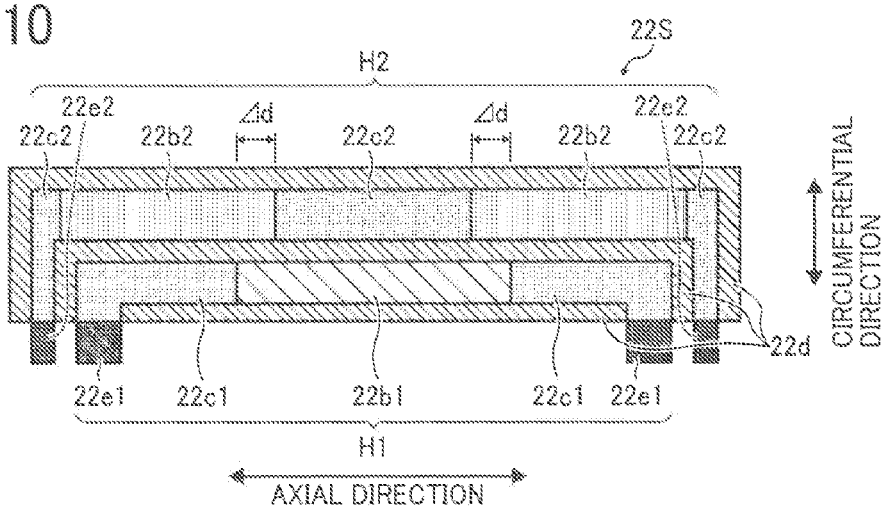
FIG. 10 is a plan view schematically showing one arrangement of the planar heat generator of FIG. 4.
Figure 11:
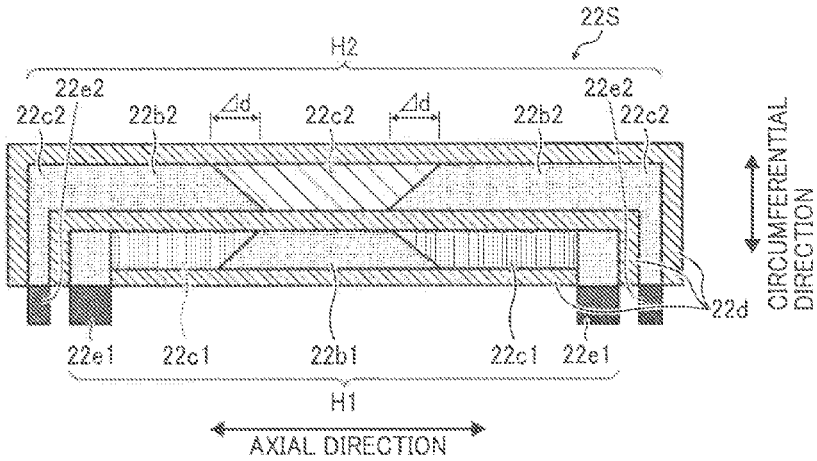
FIG. 11 is a plan view schematically showing another arrangement of the planar heat generator of FIG. 4.

In the embodiment depicted in FIG. 9, the first and second resistive regions 22*b*1 and 22*b*2 in the first and second heating circuits H1 and H2 are completely offset from each other in the axial direction. Alternatively, instead, the planar heat generator 22S may be arranged to have the resistive regions 22*b*1 and 22*b*2 only partially offset, that is, contiguous with and/or adjacent to each other through the insulating layer 22*d*. FIGS. 10 and 11 show such arrangement of the planar heat generator 22S.

As shown in FIG. 10, the planar heat generator 22S may have the first and second resistive regions 22*b*1 and 22*b*2 formed in substantially rectangular shapes contiguous with each other through the insulating layer 22*d* therebetween, so that when energized, the first and second heating circuits H1 and H2 heat one or more common areas of the fuser sleeve 21 each of which has a length Δd in the axial direction.

Such arrangement is effective where heat generated by the first and second resistive regions 22*b*1 and 22*b*2 dissipates into the insulating layers 22*d* and the first and second conductive regions 22*c*1 and 22*c*2 which are thermally conductive, so that the first and second resistive regions 22*b*1 and 22*b*2 tend to provide higher amounts of heat at their center than at their side edges for transfer to the fuser sleeve 21. With the first and second resistive regions 22*b*1 and 22*b*2 completely offset and non-contiguous with each other, such tendency results in inconsistent heat across the fuser sleeve 21 causing imperfections in printed images, in which those portions corresponding to the adjoining edges of the first and second resistive regions 22*b*1 and 22*b*2 remain cooler than other, adjacent portions of the fuser sleeve 21.

By contrast, in the arrangement of FIG. 10, the contiguous first and second resistive regions 22*b*1 and 22*b*2 can heat the fuser sleeve 21 in conjunction with each other at their adjoining edges where the amount of heat yielded by each heating circuit H1 and H2 is relatively low, resulting in uniform heat across the fuser sleeve 21, which leads to higher imaging quality of the fixing device 20.

Further, as shown in FIG. 11, the planar heat generator 22S may have the first and second resistive regions 22*b*1 and 22*b*2 formed in tapered rectangular shapes, instead of square rectangular shapes, adjacent to each other, so that when energized, the first and second heating circuits H1 and H2 heat one or more common areas of the fuser sleeve 21 each of which has a length Δd in the axial direction.

As in the embodiment depicted in FIG. 10, the contiguous first and second resistive regions 22*b*1 and 22*b*2 can heat the fuser sleeve 21 in conjunction with each other at their adjoining edges where the amount of heat yielded by each heating circuit H1 and H2 is relatively low, resulting in uniform heat across the fuser sleeve 21, which leads to higher imaging quality of the fixing device 20.

Moreover, in the arrangement of FIG. 11, the first and second resistive regions 22*b*1 and 22*b*2 have their depths or dimensions along the circumferential direction varying along the axial direction, so that the ratio of their depths varies constantly along the axial direction. Compared to a configuration in which the ratio of the depths of the first and second resistive regions 22*b*1 and 22*b*2 is fixed, varying the depths of the first and second resistive regions 22*b*1 and 22*b*2 allows for adjusting heat distribution across the fuser sleeve 21 and cancelling out undesired process variations of the planar heat generator 22S, in particular, those in the axial dimension Δd, which would otherwise result in inconsistent heat across the fuser sleeve 21.

As mentioned, the planar heat generator 22S is obtained by depositing different materials one upon each other on the substrate 22*a*, each through a patterned mask which exposes only a portion of the substrate 22*a* or previously deposited film to form the resulting layer in a desired configuration. Thus, using suitable deposition techniques, the planar heat generator 22S may be arranged to have different configurations of resistive and conductive regions by adjusting the shapes of masks used in successive deposition processes.

Figure 12:
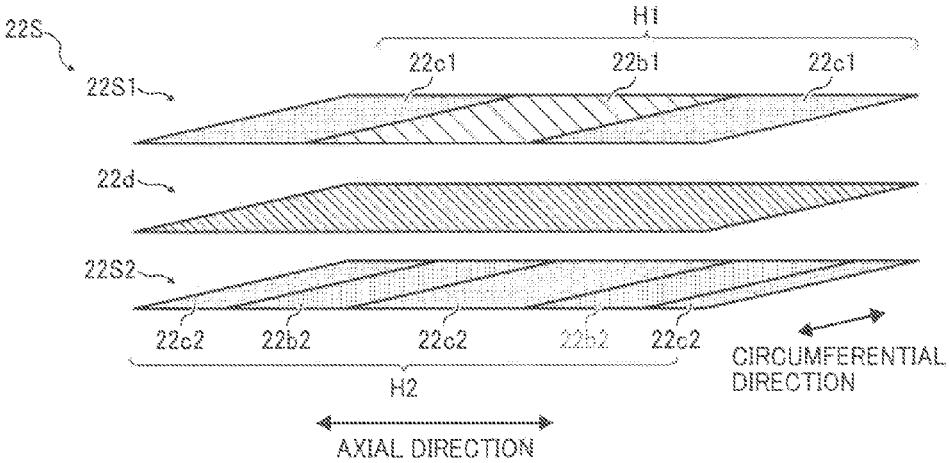
FIG. 12 is an exploded, perspective view showing a further embodiment of the planar heat generator.

In a further embodiment, the planar heat generator 22S may have a multilayered or laminated structure obtained by combining multiple layers each forming a single heating circuit. FIG. 12 is an exploded, perspective view showing such embodiment of the planar heat generator 22S.

As shown in FIG. 12, the planar heat generator 22S includes a pair of first and second layers 22S1 and 22S2 superimposed one atop another, with an insulation layer 22*d* interposed therebetween.

Specifically, the first layer 22S1 has its operational area generally divided into three sections along the axial direction to form a first heating circuit H1, consisting of a first resistive region 22*b*1 formed in the central section, and first conductive regions 22*c*1 formed in the sections on the opposed sides of the operational area.

The second layer 22S2 has its operational area divided into five sections along the axial direction to form a second heating circuit H2, consisting of second resistive regions 22*b*2 formed in two sections on the opposed sides of the central section, and second conductive regions 22*c*2 formed in the central section and the remaining two sections at the opposed ends of the operational area.

The first and second heating circuits H1 and H2 operate independently of each other with the insulation layer 22*d* provided between the first and second heating circuits H1 and H2 to prevent short-circuiting across the planar heat generator 22S.

In such a configuration, the planar heat generator 22S can selectively heat its central section corresponding to the axial center of the fuser sleeve 21 by activating the first heating circuit H1 with power supplied to cause the first resistive region 22*b*1 to generate Joule heat, leaving the first conductive regions 22*c*1 therearound substantially unheated.

By contrast, the planar heat generator 22S can selectively heat its sub-central sections corresponding to the opposed axial ends of the fuser sleeve 21 by activating the second heating circuit H2 with power supplied to cause the second resistive regions 22*b*2 to generate Joule heat, leaving the second conductive regions 22*c*2 therearound substantially unheated.

Thus, as in the embodiments depicted in FIGS. 9 through 11, the laminated planar heat generator 22S can selectively heat intended portions of the fuser sleeve 21 by activating corresponding one(s) of the first and second heating circuits H1 and H2 that operate independently of each other.

Moreover, the laminated planar heat generator 22S composed of multiple layers each having its operational area divided only along the circumferential direction provides high heat output with compact size, compared to a configuration where the operational area of the planar heat generator is divided along both the axial and circumferential directions, which would require a large operational area to generate sufficient heat for high-output application, resulting in too large an overall size of the planar heat generator to fit into a relatively small fuser sleeve.

Figure 13:
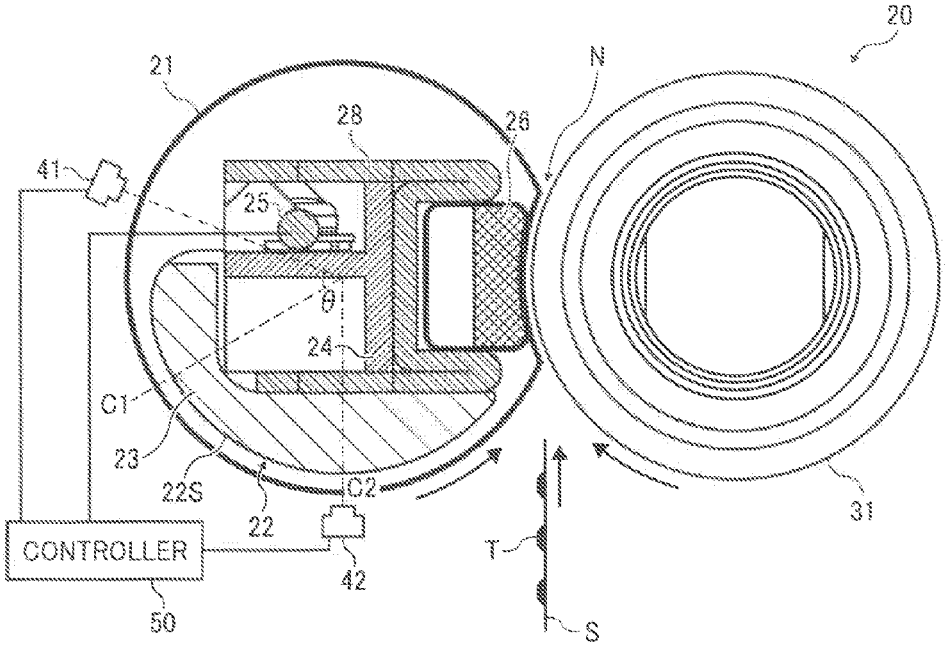
FIG. 13 is another end-on, axial cutaway view of the fixing device, shown with a heating control system according to one embodiment of this patent specification.

As mentioned earlier, the fixing device 20 according to this patent specification controls operation of the heater 22 according to readings of a thermometer disposed around the fuser sleeve 21 to detect temperature of the fuser sleeve 21 upstream of the fixing nip N. FIG. 13 is another end-on, axial cutaway view of the fixing device 20, and FIG. 14 is another plan view of the planar heat generator 22S before assembly, each shown with a heating control system according to one embodiment of this patent specification.

Figure 14:
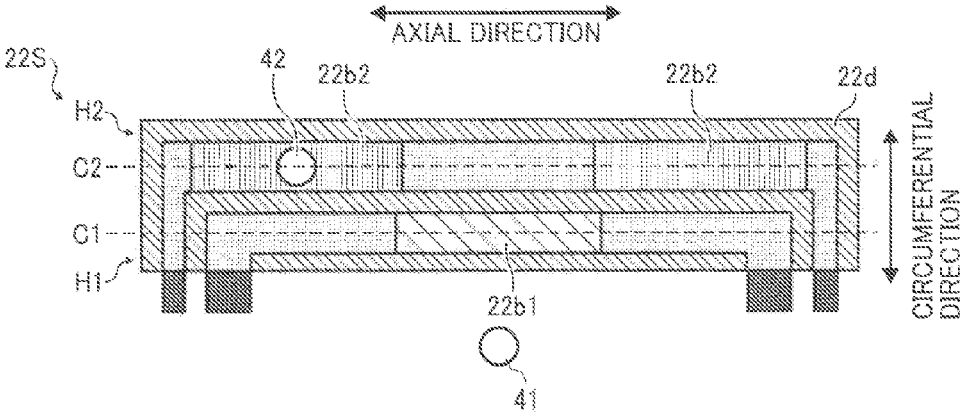
FIG. 14 is another plan view of the planar heat generator before assembly, shown with the heating control system.

As shown in FIGS. 13 and 14, the fixing device 20 includes a pair of first and second thermometers 41 and 42 disposed around the fuser sleeve 21, and a controller 50 connected to each of the first and second thermometers 41 and 42, as well as to the heater 22 via the wiring 25, which together form the heating control system that controls operation of the heater 22 according to temperature detected around the fuser sleeve 21. The controller 50 may be implemented as a CPU, with associated memory units.

In the heating control system, the first thermometer 41 detects the temperature of the fuser sleeve 21 upstream of where the first heating circuit H1 heats the fuser sleeve 21 along the circumferential direction. The first thermometer 41 is aligned with the first resistive region 22*b*1 along the axial direction, while displaced by an angle θ upstream from the first resistive region 22*b*1, or more precisely, from its circumferential center C1, along the circumferential direction. The angle θ of displacement is determined depending on the specific configuration of the fuser assembly so as to ensure the control system swiftly and properly responds to changes in the detected temperature.

The second thermometer 42 detects the temperature of the fuser sleeve 21 adjacent to where the second heating circuit H2 heats the fuser sleeve 21 along the circumferential direction. The second thermometer 42 is aligned with the second resistive region 22*b*2 along the axial direction, while overlapping the second resistive region 22*b*2, or more precisely, its circumferential center C2, along the circumferential direction.

The first and second thermometers 41 and 42 employed in the fixing device 20 may be configured as any type of temperature sensor with sufficient precision to ensure proper functioning of the heating control, including those that operate in contact with an object under measurement (e.g., contact thermistors) and those that can measure temperature of a remote, separate object (e.g., non-contact thermistors and thermopiles).

The controller 50 serves to control each of the first and second heating circuits H1 and H2 of the heater 22 by adjusting an operational parameter thereof according to readings of the first and second thermometers 41 and 42. In the present embodiment, the controller 50 comprises a power control circuit that adjusts supply of electricity to each of the multiple heating circuits H1 and H2 according to the outputs of the first and second thermometers 41 and 42.

In such a configuration, the controller 50 controls operation of the heater 22 in either first or second control modes depending on whether the fuser sleeve 21 rotates or not, or more specifically, whether the rotary drive motor of the fixing device 20 is activated or not to drive the pressure roller 31 to rotate the fuser sleeve 21.

Specifically, the controller 50 operates in the first control mode with the rotary drive motor remaining inactive where the temperature of the fuser sleeve 21 detected remains low (e.g., typically lower than 50° C. upon powerup or wakeup from low power mode operation) and does not exceed a minimum operating temperature of the fixing device 20.

In the first control mode, in response to a user switching on the image forming apparatus 1 or submitting a print request, the controller 50 activates each of the first and second heating circuits H1 and H2 of the heater 22, which generates heat for conduction directly or indirectly to the fuser sleeve 21 held stationary as the pressure roller 31 remains stationary. When the minimum operating temperature is reached, indicating that the fuser assembly is ready for printing, the rotary drive motor becomes activated to rotate the pressure roller 31, which in turn rotates the fuser sleeve 21 so as to distribute heat uniformly over the fuser sleeve 21 along the circumferential direction.

Thereafter, where there is a print request submitted for execution, the controller 50 switches to the second control mode with the rotary drive motor activated to rotate the pressure roller 31 and the fuser sleeve 21. Where there is no print request, the controller 50 maintains the fuser sleeve 21 at a given moderate temperature with the rotary drive motor deactivated to establish a standby state in preparation for immediate activation responsive to a future print request.

Operation in the first control mode results in reduced distance traveled and thus reduced power consumption by the rotary members, which allows for long life of the fixing device 20. Temperature control in the first control mode may be performed according to readings of the second thermometer 42. Using the second thermometer 42 positioned adjacent to the heater 22 rather than the first thermometer 41 positioned apart from the heater 22 allows for effective adjustment of the operational temperature during startup or standby, leading to secure operation of the heating control system in the fixing device 20.

By contrast, the controller 50 operates in the second control mode with the rotary drive motor activated to rotate the fuser sleeve 21 (e.g., before and during processing of a print job in which a recording sheet S after secondary transfer passes through the fixing nip N), so as to heat the fuser sleeve 21 to a setpoint temperature required to fuse toner particles on a recording sheet S for fixing.

In the second control mode, the controller 50 activates each of the first and second heating circuits H1 and H2 of the heater 22 with a power supply regulated according to detected temperature, which generates heat for conduction directly or indirectly to the fuser sleeve 21 rotating as the pressure roller 31 rotates.

Temperature control in the second control mode is performed according to readings of the first and second thermometers 41 and 42. Using the first and second thermometers 41 and 42 at different positions relative to the heater 22 allows for effective adjustment of the operational temperature during fixing, leading to secure operation of the heating control system in the fixing device 20.

Figure 15:
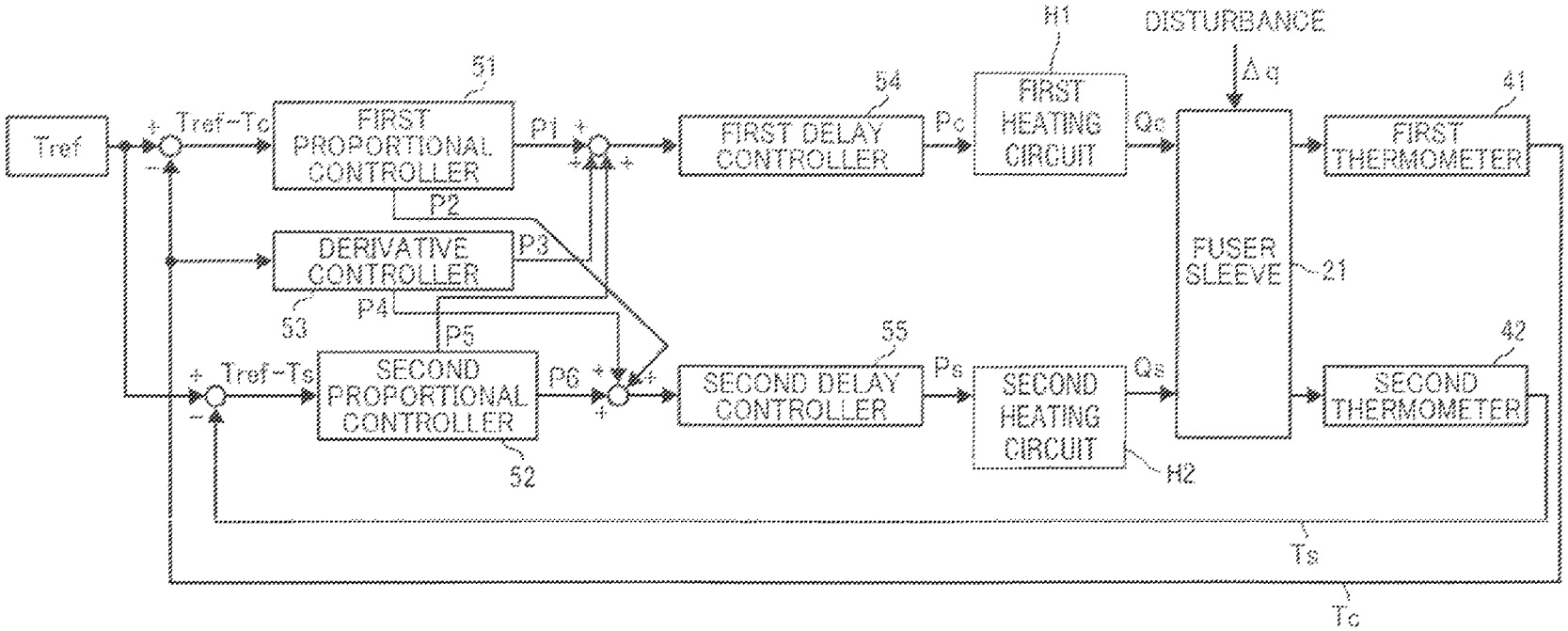
FIG. 15 is a block diagram schematically illustrating functional blocks of a controller included in the heating control system of FIG. 13.

FIG. 15 is a block diagram schematically illustrating functional blocks of the controller 50 for operation in the second control mode.

As shown in FIG. 15, the controller 50 includes a pair of first and second proportional controllers 51 and 52, a pair of first and second delay controllers 54 and 55, and optionally, a derivative controller 53, which together form feedback circuitry that regulates amounts and timing of power supply Pc and Ps to the respective heating circuits H1 and H2 to maintain a process temperature of the fuser sleeve 21 at a setpoint temperature Tref according to first and second temperatures Tc and Ts detected by the first and second thermometers 41 and 42 at the axial center and end, respectively, of the fuser sleeve 21.

Specifically, the first proportional controller 51 serves to calculate, based on a difference Tref−Tc between the setpoint temperature Tref and the first temperature Tc output from the first thermometer 41, an amount of power supply required by each heating circuit H1 and H2 to compensate for a deviation in the process temperature from the setpoint temperature Tref (labeled "P1" for the first heating circuit H1, and "P2" for the second heating circuit H2). Temperature deviations may occur due to a disturbance causing a loss or gain of heat Δq, such as entry of a recording sheet S absorbing heat from the fuser sleeve 21 upon entry into the fixing nip, or an overshoot upon a sudden change in the operating condition.

The second proportional controller 52 serves to calculate, based on a difference Tref−Ts between the setpoint temperature Tref and the second temperature Ts output from the second thermometer 42, an amount of power supply required by each heating circuit H1 and H2 to adjust the process temperature to the setpoint temperature Tref (labeled "P5" for the first heating circuit H1 and "P6" for the second heating circuit H2), so as to precisely maintain the fuser sleeve 21 at a desired temperature within, as well as immediately upstream of, the fixing nip N.

The derivative controller 53 serves to calculate, based on the first temperature Tc output from the first thermometer 41, an amount of power supply required by each heating circuit H1 and H2 to compensate for a predicted change in the process temperature (labeled "P3" for the first heating circuit H1 and "P4" for the second heating circuit H2), so as to proactively correct an undesirable trend in the control of the first heating circuit H1 as well as in the second heating circuit H2.

The values of power supply determined through such proportional and derivative control actions are summed to obtain a first collective amount of power Pc for supply to the first heating circuit H1, and a second collective amount of power Ps for supply to the second heating circuit H2, which are forwarded through the first and second delay controllers 54 and 55, respectively, each to calculate an appropriate delay time after which the power supply Pc and Ps is applied to each heating circuit H1 and H2.

Upon activation, the first heating circuit H1 produces an amount of heat Qc proportional to the amount of power supply Pc, and the second heating circuit H2 produces an amount of heat Qs proportional to the amount of power supply Ps. Generated heat is applied to the fuser sleeve 21 so as to adjust for a loss or gain of heat Δq caused by disturbance occurring during operation.

Figure 16:
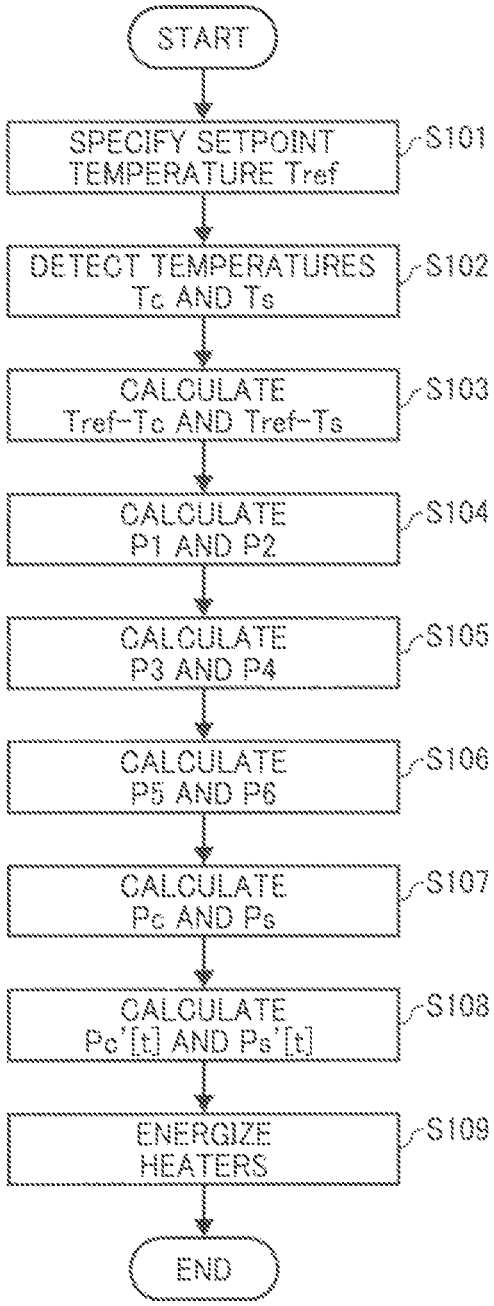
FIG. 16 is a flowchart illustrating an example of operation of the controller of FIG. 15.

FIG. 16 is a flowchart illustrating an example of operation of the controller 50, wherein a wide recording sheet S that has a maximum compatible width accommodated through the fixing device 20 enters the fixing nip N to cause a heat loss.

As shown in FIG. 16, in step S101, the controller 50 initially specifies a setpoint temperature Tref to which the temperature of the fuser sleeve 21 is adjusted, prior to entry of a recording sheet S into the fixing nip N.

In step S102, as the recording sheet S reaches the fixing nip N to cause a reduction in temperature at the axial center as well as at the axial ends of the fuser sleeve 21, the first and second thermometers 41 and 42 detect the first and second temperatures Tc and Ts, respectively, at the corresponding portions of the fuser sleeve 21.

Then, in step S103, upon receiving the detected temperatures Tc and Ts, the controller 50 calculates temperature differentials Tref−Tc and Tref−Ts.

In step S104, based on the temperature differential Tref−Tc, the controller 50 calculates an amount of power supply P1 for the first heating circuit H1 to compensate for variations in the process temperature, as given by the following equation:

$$P1=Kp1*(Tref-Tc) \quad \text{Eq. 1}$$

where "Kp1" represents a first proportional gain of the first proportional controller 51.

The controller 50 also calculates an amount of power supply P2 for the second heating circuit H2 to reduce a difference between the process temperature and the setpoint temperature, as given by the following equation:

$$P2=Kp2*(Tref-Tc) \quad \text{Eq. 2}$$

where "Kp2" represents a second proportional gain of the first proportional controller 51.

In step S105, based on the first detected temperature Tc, the controller 50 calculates an amount of power supply P3 for the first heating circuit H1 to compensate for a predicted change in the controlled process temperature, as given by the following equation:

$$P3=Kd3*(Tc[t]-Tc[t-\Delta t])/\Delta t \quad \text{Eq. 3}$$

where "Kd3" represents a first derivative gain of the derivative controller 53, "t" represents time, and "Δt" represents a control cycle.

The controller 50 also calculates an amount of power supply P4 for the second heating circuit H2 to compensate for a predicted change in the process temperature, as given by the following equation:

$$P4=Kd4*(Tc[t]-Tc[t-\Delta t])/\Delta t \quad \text{Eq. 4}$$

where "Kd4" represents a second derivative gain of the derivative controller 53, "t" represents time, and "At" represents a control cycle.

In step S106, based on the temperature differential Tref−Ts, the controller 50 calculates an amount of power supply P5 for the first heating circuit H1 to adjust the process temperature to the setpoint temperature Tref, as given by the following equation:

$$P5=Kp5*(Tref-Ts) \quad \text{Eq. 5}$$

where "Kp5" represents a first proportional gain of the second proportional controller 52.

The controller 50 also calculates an amount of power supply P6 for the second heating circuit H2 to adjust the process temperature to the setpoint temperature Tref, as given by the following equation:

$$P6=Kp6*(Tref-Ts) \quad \text{Eq. 6}$$

where "Kp6" represents a second proportional gain of the second proportional controller 52.

The equations used to calculate the amounts of power supply in the present embodiment are derived by assuming that the axial center and the axial ends of the fuser sleeve 21 are subjected to similar thermal conditions and experience similar temperature variations. Such assumption allows for determining the amounts of power supply P1 and P2 based on the output of the first thermometer 41, and determining the amounts of power supply P5 and P6 based on the output of the second thermometer 42.

In step S107, the values P1, P3, and P5 of power supply obtained through the control actions are added to yield an amount of power Pc for output to the first heating circuit H1, as follows:

$$Pc=P1+P3+P5 \quad \text{Eq. 7}$$

Also, the values P2, P4, and P6 of power supply obtained through the control actions are added to yield an amount of power Ps for output to the second heating circuit H2, as follows:

$$Ps=P2+P4+P6 \quad \text{Eq. 8}$$

In step S108, the controller 50 introduces a delay time to the resulting power supply Pc to specify a time to apply the power supply Pc to the first heating circuit H1, as follows:

$$Pc'[t]=Pc[t-d] \quad \text{Eq. 9}$$

where "t" denotes time and "d" denotes a given period of delay time provided through the first delay controller 54.

Meanwhile, the controller 50 also introduces a delay time to the resulting power supply Ps to specify a time to apply the power supply Ps to the second heating circuit H2, as follows:

$$Ps'[t]=Ps[t-d] \quad \text{Eq. 10}$$

where "t" denotes time and "d" denotes a given period of delay time provided through the second delay controller 55.

In step S109, at the timing thus specified through delay control, the controller 50 energizes the first heating circuit H1 with the amount of power Pc and the second heating circuit H2 with the amount of power Ps.

Such control enables the heater 22 to properly heat a specific portion of the fuser sleeve 21 with the heating circuits H1 and H2 each supplied with an amount of power P determined according to a temperature T detected at the same specific portion by the thermometer 41 or 42, so as to precisely adjust the temperature of the fuser sleeve 21 to a desired temperature even where entry of a recording sheet S or other disturbance causes variations in temperature at the fixing nip N.

Figure 17:
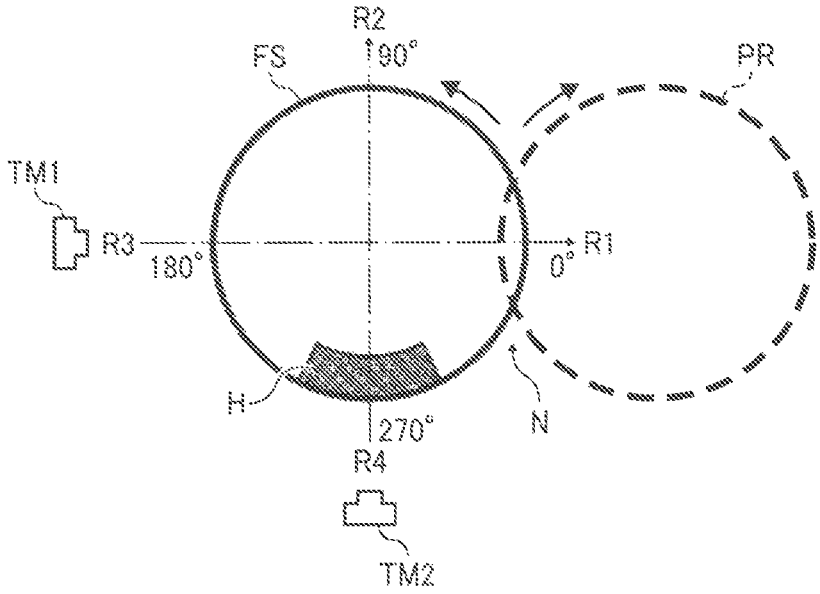
FIG. 17 shows a fuser assembly employed in experiments conducted to demonstrate efficacy of the heating control system of FIG. 13.

Experiments were conducted to demonstrate the efficacy of the heating control system according to this patent specification. FIG. 17 shows a fuser assembly employed in the experimentation.

As shown in FIG. 17, the fuser assembly used in the experiments is similar to that depicted with reference to FIGS. 13 and 14, formed of a pair of a fuser sleeve FS and a pressure roller PR opposed to define a fixing nip N therebetween, the former rotating counterclockwise and the latter clockwise in the drawing. The fuser sleeve FS is equipped with a heater H positioned upstream of the fixing nip N, as well as a pair of first and second thermometers TM1 and TM2, the former facing an axial center of the fuser sleeve FS substantially 180° opposite the fixing nip N, and the latter facing an axial end of the fuser sleeve FS spaced approximately 90° apart from, and upstream of, the fixing nip N. Although not specifically illustrated in the drawing, the heater H has a pair of central and sub-central heating circuits H1 and H2 disposed in the manner similar to that depicted in FIG. 14.

In the experiments, the fuser assembly was operated to process multiple recording sheets S in succession through the fixing nip N, while subjected to heating with the heater H under control of the controller 50 regulating the amount of power supply to each heating circuits H1 and H2, as represented by Equations 1 through 10, so as to maintain the fixing nip N at a setpoint temperature of approximately 160° C.

The temperature of the fuser sleeve FS was measured at fixed measurement points equally spaced along the circumference of the fuser sleeve FS, including a first point R1 corresponding to the fixing nip N, a second point R2 positioned 90° downstream of the fixing nip N, a third point R3 positioned 180° downstream of the fixing nip N (i.e., coincident with the first thermometer TM1), and a fourth point R4 positioned 270° downstream of the fixing nip N (i.e., coincident with the second thermometer TM2 adjacent to the heater H), each with a pair of experimental thermometers, not shown, one facing an axial center and the other facing an axial end of the fuser sleeve FS. The fuser sleeve FS made one rotation in approximately 2.0 sec, passing each measurement point every 0.5 sec during operation.

FIGS. 18A through 18D are graphs showing temperatures Tcl through Tc4 of the axial center of the fuser sleeve FS measured at the first through fourth measurement points R1 through R4, respectively, and FIGS. 19A through 19D are graphs showing temperatures Ts1 through Ts4 of the axial end of the fuser sleeve FS, measured at the first through fourth measurement points R1 through P4, respectively, in each of which the temperature is plotted in degrees Celsius against time in seconds.

Figure 18A:
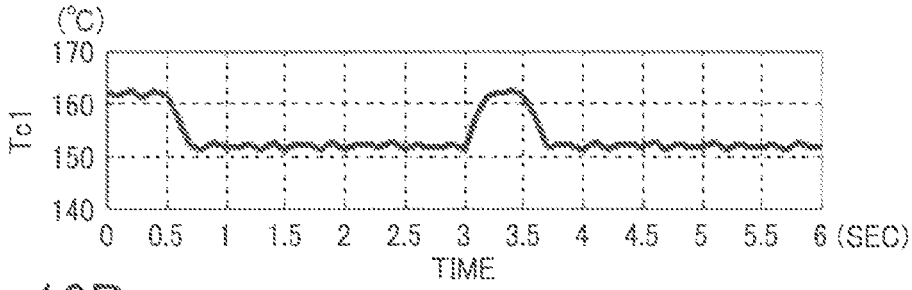
FIGS. 18A through 18D are graphs showing temperatures of an axial center of a fuser sleeve obtained through the experiments.
Figure 18B:
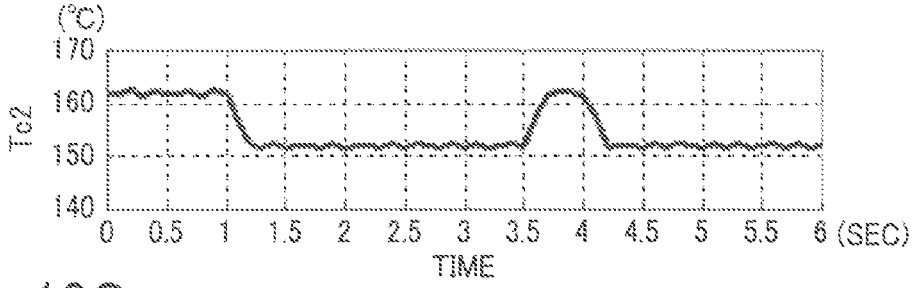
Figure 18C:
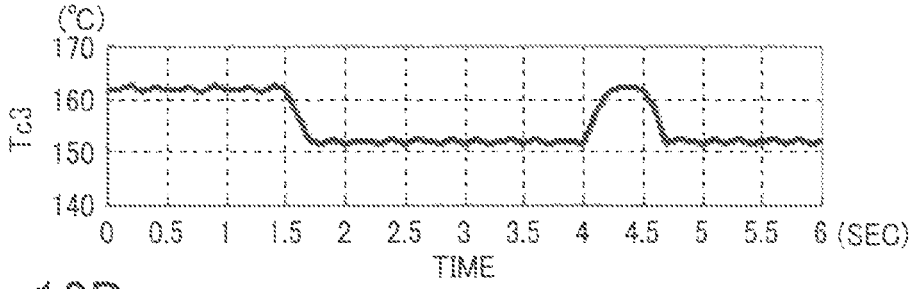
Figure 19A:
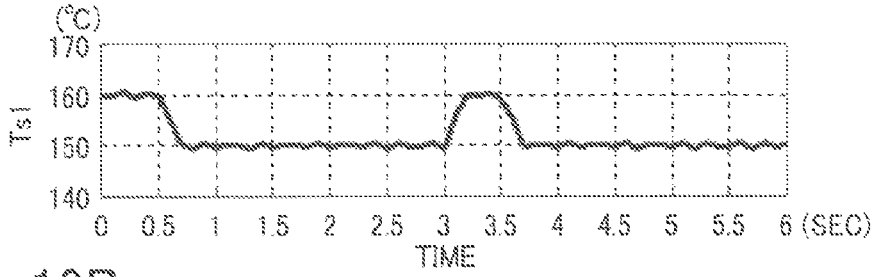
FIGS. 19A through 19D are graphs showing temperatures of an axial end of a fuser sleeve obtained through the experiments.
Figure 19B:
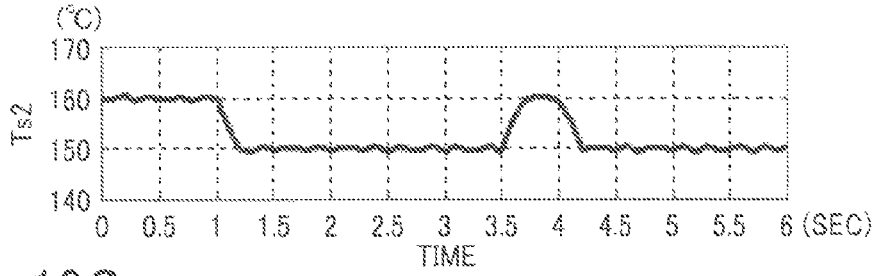
Figure 19C:
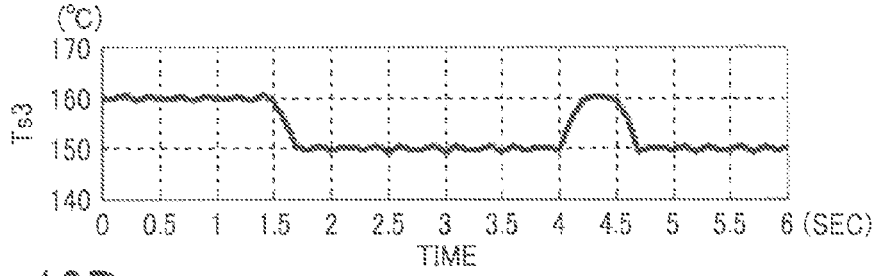

As shown in FIGS. 18A and 19A, the temperature of the fuser sleeve FS measured at the first point R1 declines to below approximately 10° C. from the setpoint temperature at time t=0.5 sec when the leading edge of the recording sheet reaches the fixing nip N, and remains the same until time t=3.0 sec when the trailing edge of the recording sheet exits the fixing nip N, which results in a portion of the fuser sleeve FS colder than the setpoint temperature.

As shown in FIGS. 18B and 19B, and FIGS. 18C and 19C, this colder portion of the fuser sleeve FS moves downstream from the fixing nip N to reach the second point R2, and then the third point R3. The result is a corresponding decline in the measured temperature at time t=1.0 sec for the second point R2, and at time t=1.5 sec for the third point R3.

Figure 18D:
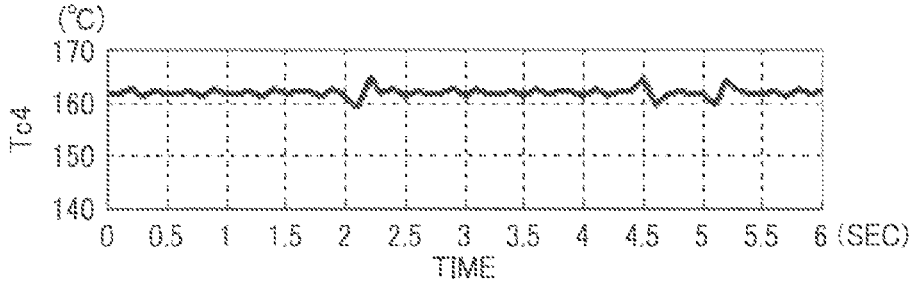
Figure 19D:
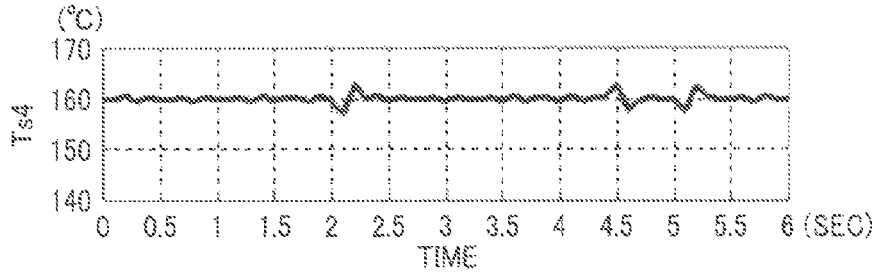

Note that, as shown in FIGS. 18D and 19D, no substantial decline in the temperature of the fuser sleeve FS is observed at the fourth point R4. This is because the controller 50 causes the heater H to intensely heat the colder portion of the fuser sleeve FS in response to the first thermometer TM1 detecting a reduction in the sleeve temperature at time t=1.5 sec.

Figure 20A:
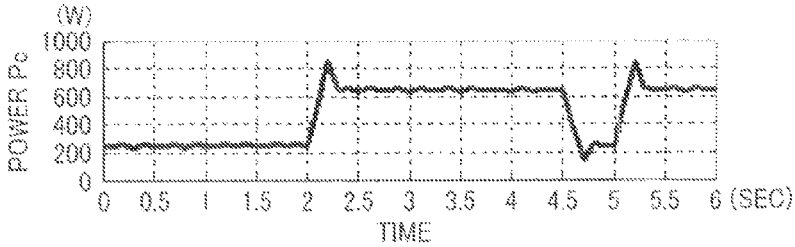
FIGS. 20A and 20B are graphs showing amounts of heater power supply observed through the experiments.
Figure 20B:
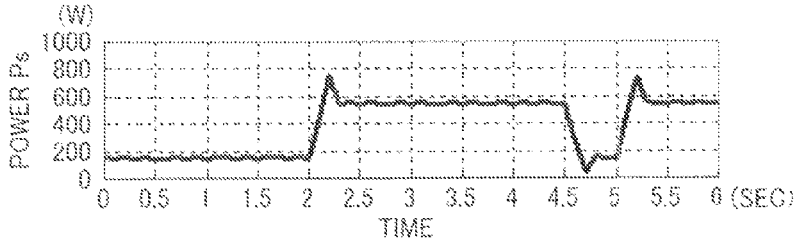

With additional reference to FIGS. 20A and 20B, which are graphs showing the amounts of power Pc and Ps in watts (W) supplied to the heating circuits H1 and H2, there is seen a temporary increase in the power supply P to each heating circuits H1 and H2 which starts from t=2.0 sec after a delay time of 0.5 sec since time t=1.5 sec required by the fuser sleeve FS to travel from the third point R3 to the fourth point R4. The power supply P to each heating circuit H1 and H2 remains substantially the same between t=2.0 sec and t=4.5 sec, during which the colder portion of the fuser sleeve FS passes through the fourth point R4 while heated to the setpoint temperature by absorbing heat from the heater H.

Hence, the results of experiments show that the heating control system according to this patent specification can maintain the fuser sleeve FS at a desired process temperature even where entry of a recording sheet causing a decline in temperature at the fixing nip N, which results in good imaging performance and uniform gloss across the resulting image.

For comparison purposes, consider a conventional configuration in which the power supply to a heater is controlled according to readings of a single thermometer positioned adjacent to the heater to detect the temperature of the fuser sleeve right where the heater supplies heat. Such heating control typically fails to maintain a constant process temperature, since the power supply to the heater responds to a change in temperature at a particular portion of the fuser sleeve only after the target portion of the fuser sleeve leaves where the heater heats the fuser sleeve.

Figure 21:
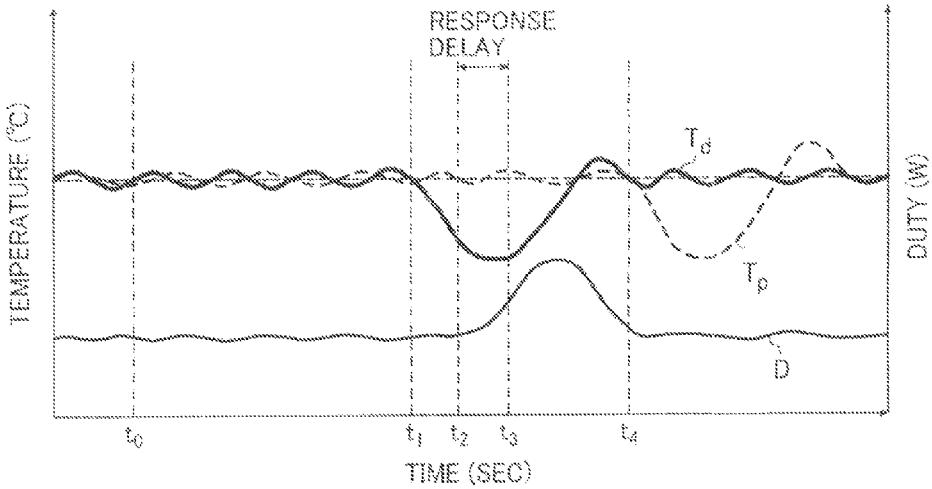
Related Art FIG. 21
FIG. 21 is a graph showing several variables of a conventional fixing device.

FIG. 21 is a graph showing several variables of a conventional fixing device employing a single thermometer to control power supply or a duty cycle of a heater, wherein "Td" represents a temperature detected by the thermometer, "D" represents the duty of the heater, and "Tp" represents a temperature measured immediately upstream of a fixing nip, all plotted against time in seconds.

As shown in FIG. 21, after entry of a recording sheet into the fixing nip at time t0, the temperature Td starts decreasing at time t1, where that portion of the fuser sleeve that has become colder upon contact with the recording sheet meets the thermometer downstream of the fixing nip. In response to the reduction in temperature Td at time t1, the heater duty D starts rising at time t2, which causes the temperature Td to start rising at time t3 after a slight time delay since time t2. Such increase in the heater duty, however, fails to heat the entire length of the colder portion, which appears as a decline in the temperature Tp immediately upstream of the fixing nip at time t4.

If not corrected, such temporary reduction in temperature after entry of a recording sheet would result in various imaging failures due to insufficient heating in the conventional fixing device. Should such temperature variations be properly corrected, the conventional configuration is still vulnerable to temperature ripples, in which the process temperature fluctuates around the setpoint temperature, causing non-uniform gloss across the resulting image.

Thus, the fixing device 20 according to this patent specification incorporates an energy-efficient, high-speed, durable fuser assembly, wherein the heating control system employs the fuser sleeve 21 of low heat capacity to heat the fixing nip N promptly and efficiently, which leads to short warmup time and first-print time, as well as reliable imaging performance to obtain a resulting print with uniform gloss in high speed applications, with the heater 22 consisting of the resin-based planar heat generator 22S to exhibit high immunity to wear and tear when repeatedly bent and strained due to vibration or rotation transmitted from the pressure roller 31, while capable of adjusting the processing temperature depending on the size of recording sheet S in use, owing to the multiple heating circuits H1 and H2 heating the fuser sleeve 21 at different positions along the axial direction.

It should be noted that although in the embodiment depicted above the controller 50 determines the amounts of power supply Pc and Ps both based on the outputs of the first and second thermometer 41 and 42, determination of power supply may be performed otherwise than as particularly described with reference to FIGS. 15 and 16. In particular, where the fixing device 20 processes a small recording sheet S narrower than the first heating circuit H1 along the axial direction by activating both the first and second heating circuits H1 and H2, the power supply Ps to the second heating circuit H2 is preferably determined based solely on the output of the second thermometer 42. Such arrangement prevents the heater 22 from overheating those portions of the fuser sleeve 21 which do not come into contact with the incoming recording sheet S and therefore tend to accumulate excessive heat flowing from the second heating circuit H2.

Moreover, although in the embodiment depicted above heating controller 50 is configured to regulate power supply to the heating circuits H1 and H2, the heating control system according to this patent specification may employ any type of controller that controls operation of the heating circuits by adjusting a specific operational parameter of the fuser assembly. For example, the controller may include an actuator or other electromechanical device to adjust the pressure with which the planar heat generator 22S contacts the surface of the fuser sleeve 21, so as to regulate conduction of heat therebetween to adjust the temperature of the fuser sleeve 21.

Figure 22:
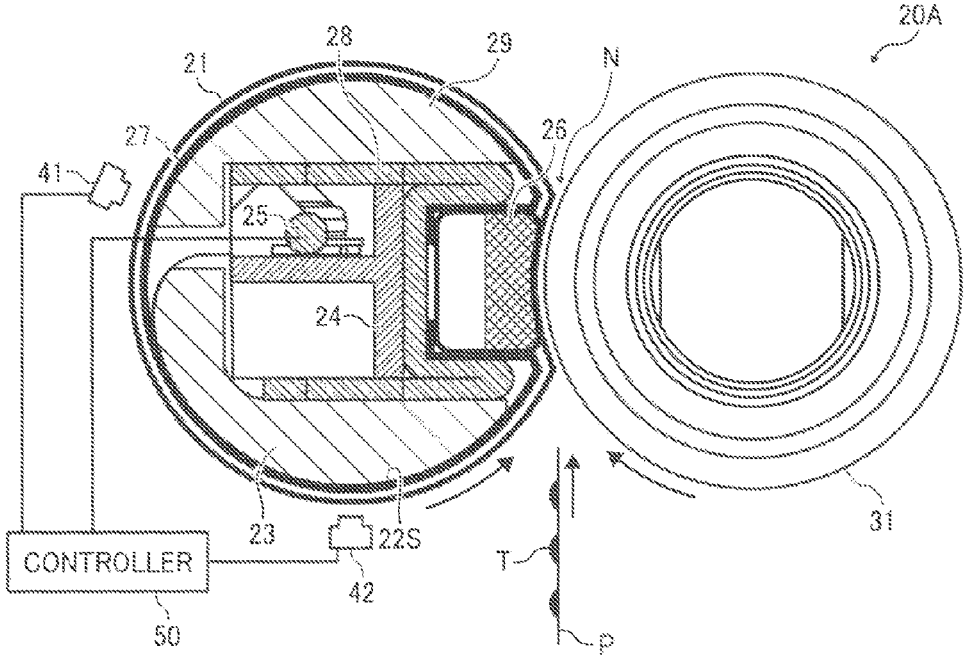
FIG. 22 is an end-on, axial cutaway view schematically illustrating a second embodiment of the fixing device according to this patent specification.

FIG. 22 is an end-on, axial cutaway view schematically illustrating a second embodiment of a fixing device 20A according to this patent specification.

As shown in FIG. 22, the overall configuration of the fixing device 20A is similar to that depicted in FIG. 2, except where the present embodiment includes a tubular sleeve holder 27 disposed inside a fuser sleeve 21 to support the fuser sleeve 21 rotating therearound, optionally equipped with a thermally insulative, internal support 29 held on a first mounting stay 28 to support the tubular sleeve holder 27 from inside, facing where the fuser sleeve 21 goes downstream of a fixing nip N.

In the fixing device 20A, the tubular sleeve holder 27 comprises a generally cylindrical pipe that has an outer diameter approximately 0.5 mm to approximately 1 mm smaller than the inner diameter of the fuser sleeve 21, for example, formed of a thin sheet of metal, such as iron or stainless steel, approximately 0.1 mm to approximately 1 mm in thickness. The tubular sleeve holder 27 has a longitudinal slot at one side thereof, defined by opposed edges bent inward away from the cylindrical circumference, which accommodates a contact pad 26 so that the tubular sleeve holder 27 itself does not contact the fuser sleeve 21 or a pressure roller 31 forming the fixing nip N therebetween.

Preferably, the tubular sleeve holder 27 is provided with a lubricant, such as silicone oil or fluorine grease, deposited on its outer surface facing the inner surface of the fuser sleeve 21. Such provision of lubricant may reduce frictional resistance at the interface where the fuser sleeve 21 rotates in sliding contact with the tubular sleeve holder 27.

The internal support 29 comprises a rigid piece of heat-resistant, thermally insulating material, with its one side defining a curved surface along which the tubular sleeve holder 27 is held in contact or close proximity with the inner circumference of the fuser sleeve 21. The internal support 29 may be of any thermal insulator that exhibits high heat resistance to resist heat emanating from the fuser sleeve 21 through the tubular sleeve holder 27, high mechanical strength to support the tubular sleeve holder 27 without deformation upon contacting the rotating fuser sleeve 21, and good insulation performance to prevent heat from flowing to the interior of the tubular sleeve holder 27 retaining heat for conduction to the fuser sleeve 21. For example, the internal support 29 may be configured as a molded piece of polyimide resin foam, as is the case with the heater support 23 described with reference to FIG. 2.

In such a configuration, the tubular sleeve holder 27 serves to ensure the fuser sleeve 21 properly rotates even at high rotational speeds, and incidentally, to equalize heat distribution across the fuser sleeve 21 by conducting heat from the heater 22 for transfer to the fuser sleeve 21.

Specifically, the fuser sleeve 21 during rotation is subjected to different tensions as it passes from upstream to downstream of the fixing nip N. Upstream of the fixing nip N, the fuser sleeve 21 is relatively tight as it is drawn by the pressure roller 31 toward the fixing nip N, with its inner circumference sliding over the heater 22 in pressure contact with the heater support 23. Conversely, downstream of the fixing nip N, the fuser sleeve 21 is relatively loose as it is relieved of tension from the pressure roller 31. If not corrected, such looseness may adversely affect rotation of the fuser sleeve 21 downstream of the fixing nip N, which can be intolerable where the fuser sleeve 21 rotates at higher rotating speeds for high-speed application.

Provision of the tubular sleeve holder 27 holds the fuser sleeve 21 in its generally cylindrical configuration during rotation, which enables the fuser sleeve 21 to remain tight downstream of the fixing nip N, leading to stable operation of the fixing device 20A.

The tubular sleeve holder 27 may be formed of different materials, and in different configurations and positions with respect to the heater 22 depending on specific applications, as described below with reference to FIGS. 23A through 23E.

Figure 23A:
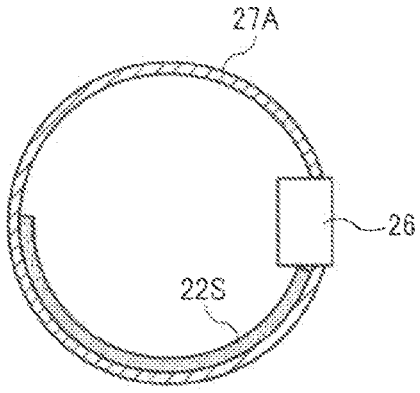
FIGS. 23A through 23E illustrate different configurations of a tubular sleeve holder employed in the fixing device of FIG. 22.

For example, as shown in FIG. 23A, the tubular sleeve holder 27 may be configured as a thin-walled metal pipe 27A, such as iron or stainless steel, holding the planar heat generator 22S attached to its inner circumference.

Using the thin-walled metal pipe 27A, which exhibits sufficient rigidity to stably hold the fuser sleeve 21 therearound, not only stabilizes rotation of the fuser sleeve 21 during operation, but also facilitates handling of the flexible sleeve 21 during assembly. Moreover, positioning the planar heat generator 22S inside the metal pipe 27A leads to durable, reliable operation of the fuser assembly, since it keeps the fuser sleeve 21 away from direct sliding contact with the planar heat generator 22S, which would otherwise cause abrasion of protective or insulation coatings on the surface of the planar heat generator 22S, resulting in electrical leakage from exposed surfaces of the resistive heating layer and the electrode layer conducting current.

Figure 23B:
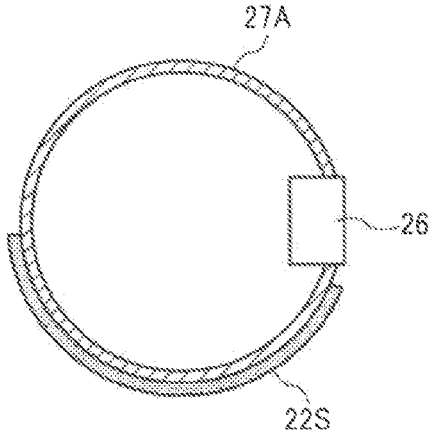

Alternatively, as shown in FIG. 23B, the thin-walled metal pipe 27A may have the planar heat generator 22S attached to its outer circumference instead of its inner circumference.

As is the case with the configuration depicted above, using the rigid metal pipe 27A allows for stable rotation of the fuser sleeve 21 during rotation as well as ready handling of the fuser sleeve 21 during assembly. Moreover, positioning the planar heat generator 22S outside the metal pipe 27A allows for immediate transfer of heat from the planar heat generator 22S to the fuser sleeve 21 which leads to increased thermal efficiency of the fuser assembly, while possibly compromising the ability to prevent direct contact between the planar heat generator 22S and the fuser sleeve 21.

Figure 23C:
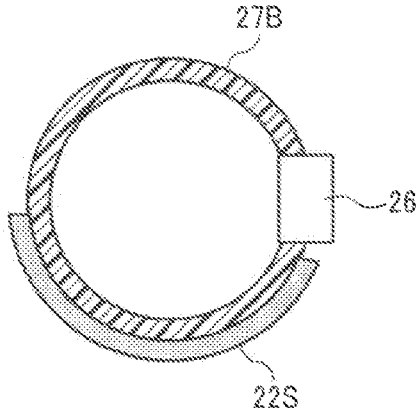

Still alternatively, as shown in FIG. 23C, the tubular sleeve holder 27 may be configured as a thin-walled solid resin pipe 27B, instead of metal, holding the planar heat generator 22S attached to its outer circumference.

Compared to a metal pipe which cannot completely prevent heat loss due to dissipation, the solid resin pipe 27B can effectively prevent heat from flowing from the planar heat generator 22S opposite the fuser sleeve 21 as solid resin in general exhibits lower thermal conductivity than metal. This alternative is thus superior in terms of thermal efficiency where the planar heat generator 22C is disposed outside the pipe, but can involve increased manufacturing cost when using a specific type of resin to obtain sufficient heat resistance comparable to that of metal.

Figure 23D:
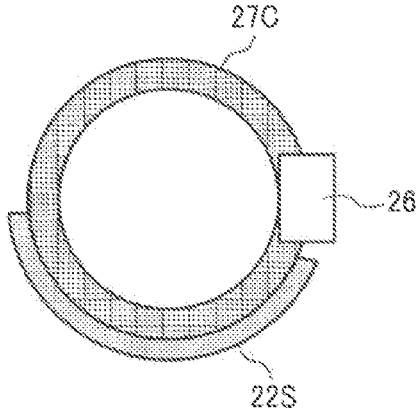

Yet still alternatively, as shown in FIG. 23D, the tubular sleeve holder 27 may be configured as a thin-walled resin pipe 27C of polyimide foam, instead of solid resin, holding the planar heat generator 22S attached to its outer circumference.

Figure 23E:
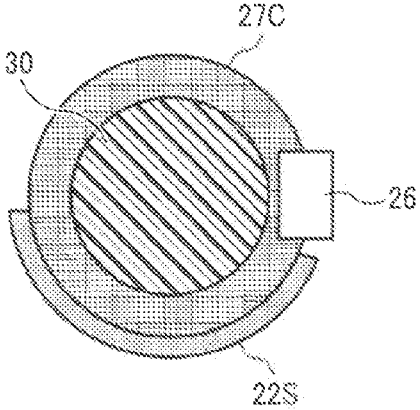

The foamed resin pipe 27C exhibits good thermal insulation to prevent heat dissipation as well as sufficient rigidity to stably hold the fuser sleeve 21 therearound. Optionally, as shown in FIG. 23E, the foamed resin pipe 27C may be provided with a circular or cylindrical member 30 of resin fitted inside for reinforcement and increased rigidity.

Figure 24A:
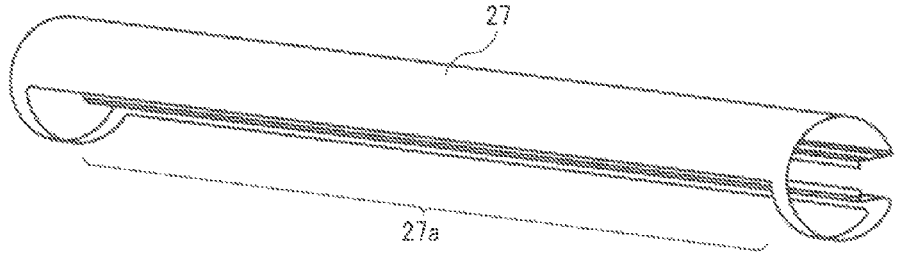
FIGS. 24A and 24B are perspective views schematically illustrating an arrangement of the tubular sleeve holder before and during assembly, respectively, for use in the fixing device of FIG. 22.
Figure 24B:
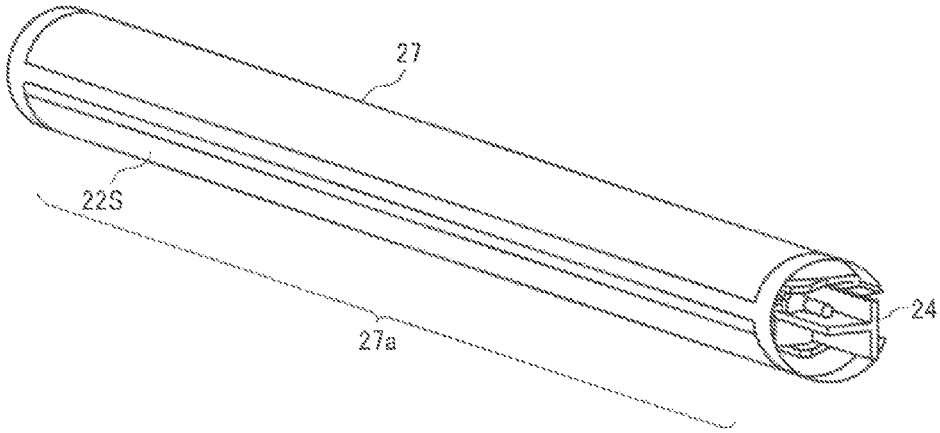

FIGS. 24A and 24B are perspective views schematically illustrating an arrangement of the tubular sleeve holder 27 before and during, respectively, assembly with the planar heat generator 22S and its associated structure.

As shown in FIG. 24A, the tubular sleeve holder 27 may have an elongated window or opening 27*a* formed by removing a particular portion of the circumference extending in the axial direction, which faces the planar heat generator 22S upon installation of the fuser assembly. As shown in FIG. 24B, the tubular sleeve holder 27 is assembled with the internal structure of the fuser assembly so that the entire operational area of the planar heat generator 22S is exposed through the opening 27*a*.

Figure 25:
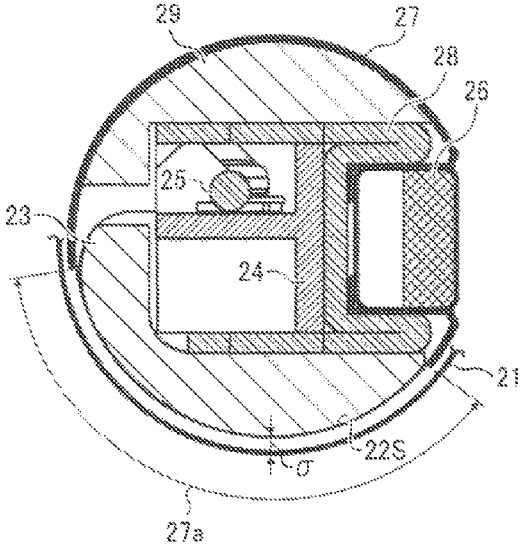
FIG. 25 is an end-on, axial cutaway view schematically illustrating the tubular sleeve holder of FIGS. 24A and 24B in the fixing device of FIG. 22.

With additional reference to FIG. 25, which is an end-on, axial cutaway view schematically illustrating the tubular sleeve holder 27 with the opening 27*a* in the complete fuser assembly, the fuser sleeve 21 is shown with its inner surface at a distance or spacing 6 from the planar heat generator 22S exposed through the opening 27*a* of the tubular sleeve holder 27. Considering that the fuser sleeve 21 tightens around the tubular sleeve holder 27 during operation, the spacing δ may fall in the range greater than zero and equal to or smaller than the thickness of the tubular sleeve holder 27 (e.g., not exceeding 1 mm).

Provision of the opening 27*a* thus allows for positioning the fuser sleeve 21 in close proximity with the planar heat generator 22S, which promotes efficient heat transfer from the planar heat generator 22S to the fuser sleeve 21, leading to high thermal efficiency in heating the fuser sleeve 21 equipped with the tubular sleeve holder 27. Such arrangement is particularly effective where the tubular sleeve holder 27 is configured as a thin-walled metal pipe, which exhibits a relatively high heat capacity and therefore can cause the fuser sleeve 21 to take extra time to warm up upon activation of the fixing device 20A.

Referring back to FIG. 22, the fixing device 20A is shown with the pair of first and second thermometers 41 and 42 and the controller 50 forming the heating control system according to this patent specification. As in the case with the first embodiment, the heating control system switches the control mode between the first control mode and the second control mode, depending on whether the fuser sleeve 21 rotates or not, detailed description of which is omitted for brevity.

Preferably, in the present embodiment, the controller 50 heats the fuser sleeve 21 firstly to a sub-minimum operating temperature in a stationary state, and subsequently to a minimum operating temperature in a rotating state where the temperature of the fuser sleeve 21 detected remains low, e.g., upon powerup or wakeup from low-power mode operation.

Specifically, the controller 50 operates in the first control mode with the rotary drive motor remaining inactive where the temperature of the fuser sleeve 21 detected remains low and does not exceed a sub-minimum operating temperature (e.g., 100° C.) lower than a minimum operating temperature of the fixing device 20A.

In the first control mode, the controller 50 activates each of the multiple heating circuits H1 and H2 of the heater 22, which generates heat for conduction directly or indirectly to the fuser sleeve 21 held stationary as the pressure roller 31 remains stationary. When the sub-minimum operating temperature is reached, the rotary drive motor becomes activated to rotate the pressure roller 31, which in turn rotates the fuser sleeve 21 to equalize the temperature of the fuser sleeve 21 along the circumferential direction. The controller 50 continues heating the rotating fuser sleeve 21 until the minimum operating temperature is detected to indicate that the fuser assembly is ready for printing.

Thereafter, where there is a print request submitted for execution, the controller 50 switches to the second operation mode with the rotary drive motor activated to rotate the pressure roller 31 and the fuser sleeve 21.

Such arrangement ensures secure operation of the fixing device 20A particularly where the fuser assembly is provided with a lubricant deposited between the fuser sleeve 21 and the tubular sleeve holder 27. This is because rotating the fuser sleeve 21 only after its temperature rises to a certain degree allows the fuser sleeve 21 to smoothly rotate around the tubular sleeve holder 27 without undue friction or resistance, where the lubricant, which exhibits relatively high viscosity at lower temperature, becomes less viscous when sufficiently heated by the fuser sleeve 21. Reduced frictional resistance at the interface of the fuser sleeve 21 and the tubular sleeve holder 27 prevents the risk of increasing load or torque required for the rotating member, which would otherwise result in concomitant failure or damage of the fuser sleeve 21, as well as that of the rotary drive motor and its associated structure.

Thus, similar to the embodiment depicted earlier, the fixing device 20A according to this patent specification incorporates an energy-efficient, high-speed, durable fuser assembly, wherein the heating control system employs the fuser sleeve 21 of low heat capacity to heat the fixing nip N promptly and efficiently, which leads to short warmup time and first-print time, as well as reliable imaging performance to obtain a resulting print with uniform gloss in high speed applications, with the heater 22 consisting of the resin-based planar heat generator 22S to exhibit high immunity to wear and tear when repeatedly bent and strained due to vibration or rotation transmitted from the pressure roller 31, while capable of adjusting the processing temperature depending on the size of recording sheet S in use, owing to the multiple heating circuits H1 and H2 heating the fuser sleeve 21 at different positions along the axial direction.

In addition, the fixing device 20A provided with the tubular sleeve holder 27 as well as the optional internal support 29 is highly adapted for high-speed applications, wherein entraining the fuser sleeve 21 around the tubular sleeve holder 27 stabilizes rotation of the fuser sleeve 21, while equalizing temperature distribution across the fuser sleeve 21 to ensure uniform heating of the fixing nip N even where the fixing device 20A is driven at higher processing speeds.

Figure 26:
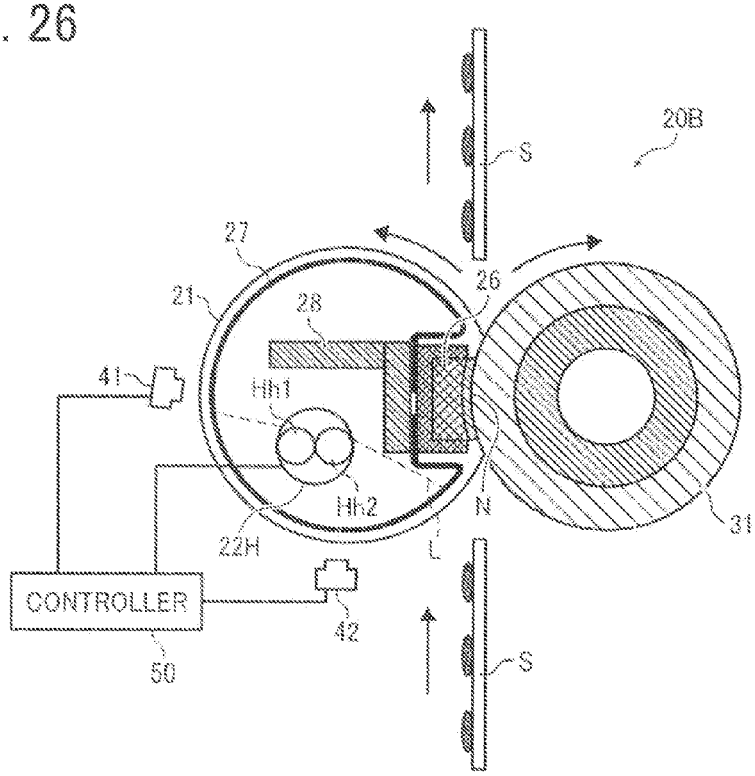
FIG. 26 is an end-on, axial cutaway view schematically illustrating a third embodiment of the fixing device according to this patent specification.

FIG. 26 is an end-on, axial cutaway view schematically illustrating a third embodiment of a fixing device 20B according to this patent specification.

As shown in FIG. 26, the overall configuration of the fixing device 20B is similar to that depicted in FIG. 22, except where the present embodiment employs a rod-shaped radiant heater 22H formed of a pair of first and second heating elements Hh1 and Hh2, in place of the planar heat generator 22S equipped with the heater support 23, the second mounting stay 24, and the internal support 29 as depicted in the second embodiment.

In the fixing device 20B, the radiant heating elements Hh1 and Hh2 each comprises an elongated halogen heater both extending in the axial direction, the former having a radiator thereof facing the axial center of the fuser sleeve 21, and the latter having a radiator thereof facing each axial end of the fuser sleeve 21, each provided with a dedicated power supply regulated by the controller 50 according to readings of the first and second thermometers 41 and 42. Broken lines L in FIG. 26 indicate where the fuser sleeve 21 is irradiated by the radiant heater 22H with the two heating elements Hh1 and Hh2 both activated.

As in the embodiments depicted earlier, in the direction of rotation of the fuser sleeve 21, the first thermometer 41 detects the temperature of the fuser sleeve 21 upstream of where the first heating element Hh1 heats the fuser sleeve 21, and the second thermometer 42 detects the temperature of the fuser sleeve 21 adjacent to where the second heating element Hh2 heats the fuser sleeve 21.

Specifically, the first thermometer 41 is aligned with the radiator of the first heating element Hh1 along the axial direction, while displaced upstream from the radiator of the first heating element Hh1, or more precisely, from the center of where the fuser sleeve 21 is irradiated by the first heating element Hh1, along the circumferential direction.

The second thermometer 42 is aligned with one radiator of the second heating element Hh2 along the axial direction, while overlapping the second heating element Hh2, or more precisely, over the center of where the fuser sleeve 21 is irradiated by the second heating element Hh2, along the circumferential direction.

The controller 50 serves to control each of the first and second heating elements Hh1 and Hh2 of the heater 22H by adjusting an operational parameter thereof according to readings of the first and second thermometers 41 and 42. In the present embodiment, the controller 50 comprises a power control circuit that adjusts supply of electricity to each of the multiple heating elements H1 and H2 according to the outputs of the first and second thermometers 41 and 42 in a manner similar to that depicted in the first embodiment.

Such heating control enables the radiant heater 22H to properly heat a specific portion of the fuser sleeve 21 with the heating first and second elements Hh1 and Hh2 each supplied with an amount of power determined according to a temperature detected at the same specific portion by the first and second thermometer 41 or 42, so as to precisely adjust the temperature of the fuser sleeve 21 to a desired temperature even where entry of a recording sheet S or other disturbance causes variations in temperature at the fixing nip N.

Figure 27:
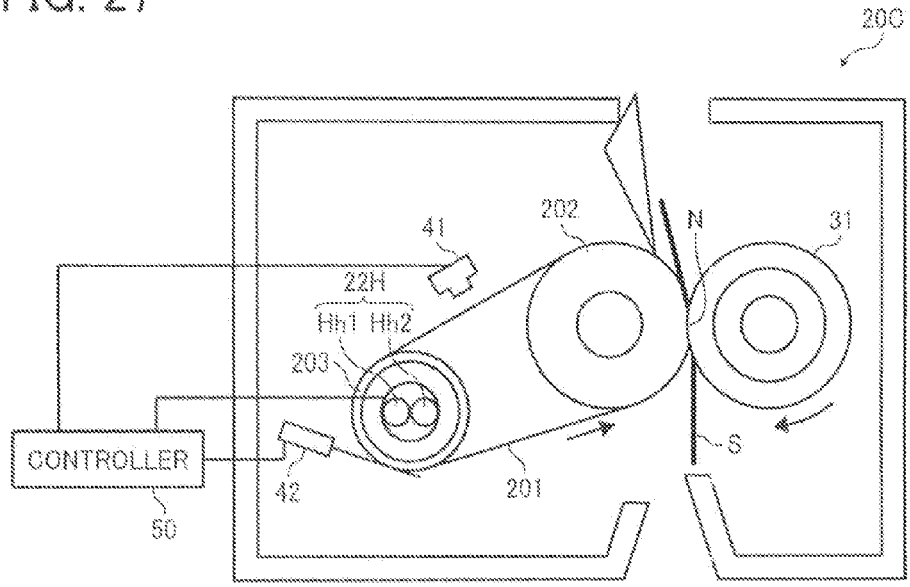
FIG. 27 is an end-on, axial cutaway view schematically illustrating a fourth embodiment of the fixing device according to this patent specification.

FIG. 27 is an end-on, axial cutaway view schematically illustrating a fourth embodiment of a fixing device 20C according to this patent specification.

As shown in FIG. 27, the overall configuration of the fixing device 20C is similar to that depicted in FIG. 26, except where the present embodiment employs a fuser assembly formed of an endless fuser belt 201 entrained around a fuser roller 202 and a heat roller 203, in place of the fuser sleeve 21 combined with the contact pad 26 and other associated structure, such as the tubular sleeve holder 27 and the first mounting stay 28, as depicted in the second embodiment.

In the fixing device 20C, the fuser roller 202 is pressed against a pressure roller 31 via the fuser belt 201 to form a fixing nip N therebetween. The heat roller 203 is internally heated with the rod-shaped radiant heater 22H formed of the pair of heating elements Hh1 and Hh2. As the pressure roller 31 rotates clockwise in the drawing, the fuser belt 201 rotates counterclockwise in the drawing around the rollers 202 and 203, with its circumference subjected to heating by conduction from the heat roller 203.

The first and second heating elements Hh1 and Hh2 each comprises an elongated halogen heater both extending in the axial direction, the former having a radiator thereof facing the axial center of the fuser belt 201; and the latter having a radiator thereof facing each axial end of the fuser sleeve belt, each provided with a dedicated power supply regulated by a controller 50 according to readings of first and second thermometers 41 and 42.

As in the embodiments depicted earlier, in the direction of rotation of the fuser belt 201, the first thermometer 41 detects the temperature of the fuser belt 201 upstream of where the first heating element Hh1 heats the fuser belt 201, and the second thermometer 42 detects the temperature of the fuser belt 201 adjacent to where the second heating element Hh2 heats the fuser belt 201.

Specifically, the first thermometer 41 is aligned with the radiator of the first heating element Hh1 along the axial direction, while displaced upstream from the radiator of the first heating element Hh1, or more precisely, from the center of where the heat roller 203 is irradiated by the first heating element Hh1, along the circumferential direction.

The second thermometer 42 is aligned with one radiator of the second heating element Hh2 along the axial direction, while overlapping the second heating element Hh2, or more precisely, over the center of where the heat roller 203 is irradiated by the second heating element Hh2, along the circumferential direction.

The controller 50 serves to control each of the first and second heating elements Hh1 and Hh2 of the radiant heater 22H by adjusting an operational parameter thereof according to readings of the first and second thermometers 41 and 42. In the present embodiment, the controller 50 comprises a power control circuit that adjusts supply of electricity to each of the multiple heating elements Hh1 and Hh2 according to the outputs of the first and second thermometers 41 and 42 in a manner similar to that depicted in the first embodiment.

Such heating control enables the radiant heater 22H to properly heat a specific portion of the fuser belt 201 with the first and second heating elements Hh1 and Hh2 each supplied with an amount of power determined according to a temperature detected at the same specific portion by the first thermometer 41 or second thermometer 42, so as to precisely adjust the temperature of the fuser belt 201 to a desired temperature even where entry of a recording sheet S or other disturbance causes variations in temperature at the fixing nip N.

Hence, in several embodiments depicted herein, the fixing device according to this patent specification incorporates an energy-efficient, high-speed, durable fuser assembly, wherein a heating control system employs a fuser sleeve of low heat capacity to heat a fixing nip promptly and efficiently, which leads to short warmup time and first-print time, as well as reliable imaging performance to obtain a resulting print with uniform gloss in high speed applications, while capable of adjusting the processing temperature depending on the size of recording sheet in use to conserve energy, owing to multiple heating elements heating the fuser sleeve at different positions along the axial direction. The image forming apparatus incorporating the fixing device benefits from these and other features of the heating control system according to this patent specification.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

an endless fuser belt looped into a generally cylindrical configuration extending in an axial direction thereof for rotation along a circumferential direction thereof;

a contact member extending in the axial direction inside the loop of the fuser belt;

a pressure member extending in the axial direction with the fuser belt interposed between the contact member and the pressure member, the pressure member being pressed against the contact member through the fuser belt to form a fixing nip through which a recording medium is passed under heat and pressure;

a heater to heat the fuser belt to a setpoint temperature, the heater including:

a first heating element to heat the fuser belt at a first position; and a second heating element to heat the fuser belt at a second position, different from the first position along the axial direction;

a first thermometer to detect a first temperature of the fuser belt upstream of the first position along the circumferential direction;

a second thermometer to detect a second temperature of the fuser belt facing the second position; and a controller connected to the first and second thermometers to control each of the first and second heating elements by adjusting an operational parameter thereof according to the first and second detected temperatures at least where the fuser belt rotates.

2. The fixing device according to claim 1, wherein the operational parameter comprises an amount of power supplied to each heating element to generate a corresponding amount of heat for transmission to the fuser belt.

3. The fixing device according to claim 2, wherein the controller includes:

a first proportional controller connected to the first thermometer to calculate a first amount of power required by each heating element to compensate for a deviation in the first temperature from the setpoint temperature based on the first detected temperature; and a second proportional controller connected to the second thermometer to calculate a second amount of power required by each heating element to adjust the second temperature to the setpoint temperature based on the second detected temperature, the first and second amounts of power being added together to determine the amount of power for supply to each heating element.

4. The fixing device according to claim 3, wherein the controller further includes:

a derivative controller connected to the first thermometer to calculate a third amount of power required by each heating element to compensate for a predicted change in the first temperature based on the first detected temperature, the first through third amounts of power being added together to determine the amount of power for supply to each heating element.

5. The fixing device according to claim 1, wherein the first heating element heats a center of the fuser belt along the axial direction, and the second heating element heats an end of the fuser belt along the axial direction.

6. The fixing device according to claim 1, wherein adjustment of the operational parameter is performed based on both the first and second detected temperatures where the fuser belt rotates, and based only on the second detected temperature where the fuser belt does not rotate.

7. The fixing device according to claim 1, wherein the first and second heating elements comprise separate resistive heating circuits formed on a single planar substrate.

8. The fixing device according to claim 1, wherein the first and second heating elements comprise separate radiant heaters assembled into a rod-shaped configuration.

9. The fixing device according to claim 1, wherein the operational parameter comprises an amount of pressure with which each heating element contacts the fuser belt to cause a corresponding amount of heat to flow into the fuser belt.

10. The fixing device according to claim 1, further comprising a tubular holder extending in the axial direction inside the loop of the fuser belt to retain the fuser belt in its generally cylindrical shape.

11. An image forming apparatus comprising:

an electrophotographic imaging unit to form a toner image on a recording medium; and a fixing device to fix the toner image in place on the recording medium, the fixing device including:

an endless fuser belt looped into a generally cylindrical configuration extending in an axial direction thereof for rotation along a circumferential direction thereof;

a contact member extending in the axial direction inside the loop of the fuser belt;

a pressure member extending in the axial direction with the fuser belt interposed between the contact member and the pressure member, the pressure member being pressed against the contact member through the fuser belt to form a fixing nip through which the recording medium is passed under heat and pressure;

a heater to heat the fuser belt to a setpoint temperature, the heater including:

a first heating element to heat the fuser belt at a first position; and a second heating element to heat the fuser belt at a second position, different from the first position along the axial direction;

a first thermometer to detect a first temperature of the fuser belt upstream of the first position along the circumferential direction;

a second thermometer to detect a second temperature of the fuser belt facing the second position; and a controller connected to the first and second thermometers to control each of the first and second heating elements by adjusting an operational parameter thereof according to the first and second detected temperatures at least where the fuser belt rotates.

12. A method to control heating in a fixing device, the fixing device including:

an endless fuser belt looped into a generally cylindrical configuration extending in an axial direction thereof for rotation along a circumferential direction thereof;

a contact member extending in the axial direction inside the loop of the fuser belt;

a pressure member extending in the axial direction with the fuser belt interposed between the contact member and the pressure member, the pressure member being pressed against the contact member through the fuser belt to form a fixing nip through which a recording medium is passed under heat and pressure;

a heater to heat the fuser belt to a setpoint temperature, the heater including:

a first heating element to heat the fuser belt at a first position; and a second heating element to heat the fuser belt at a second position, different from the first position along the axial direction, the method comprising the steps of:

detecting a first temperature of the fuser belt upstream of the first position along the circumferential direction;

detecting a second temperature of the fuser belt facing the second position; and controlling each of the first and second heating elements by adjusting an operational parameter thereof according to the first and second detected temperatures at least where the fuser belt rotates.

* * * * *